US008155868B1

(12) United States Patent
Xing et al.

(10) Patent No.: US 8,155,868 B1
(45) Date of Patent: Apr. 10, 2012

(54) MANAGING VEHICLE EFFICIENCY

(75) Inventors: Daniel Xing, San Jose, CA (US); Vinuth Rai, Mountain View, CA (US); Roger D. Melen, Los Altos Hills, CA (US); Matthew Kresse, Sunnyvale, CA (US); Kezhu Hong, Sunnyvale, CA (US)

(73) Assignee: Toyota InfoTechnology Center Co., Ltd., Tokyo (JP)

( * ) Notice: Subject to any disclaimer, the term of this patent is extended or adjusted under 35 U.S.C. 154(b) by 467 days.

(21) Appl. No.: 12/415,877

(22) Filed: Mar. 31, 2009

(51) Int. Cl.
*G06G 7/70* (2006.01)

(52) U.S. Cl. ..... 701/123; 340/439; 701/36

(58) Field of Classification Search ..... 340/901–905, 340/988, 438, 439, 441, 442, 449, 500, 501, 340/407.1, 815.4, 384.1; 700/28, 29, 32, 700/44, 45; 701/36, 70, 99, 116, 117, 123, 701/213
See application file for complete search history.

(56) References Cited

U.S. PATENT DOCUMENTS

| | | | | |
|---|---|---|---|---|
| 4,390,841 | A * | 6/1983 | Martin et al. | 324/427 |
| 5,426,589 | A * | 6/1995 | Kitagawa et al. | 700/274 |
| 5,487,002 | A | 1/1996 | Diller et al. | |
| 5,742,914 | A | 4/1998 | Hagenbuch | |
| 5,913,917 | A * | 6/1999 | Murphy | 701/123 |
| 6,166,449 | A * | 12/2000 | Takaoka et al. | 290/40 B |
| 6,230,496 | B1 | 5/2001 | Hofmann et al. | |
| 6,556,906 | B1 * | 4/2003 | Hesse et al. | 701/36 |
| 6,625,539 | B1 * | 9/2003 | Kittell et al. | 701/213 |
| 6,765,495 | B1 * | 7/2004 | Dunning et al. | 340/903 |
| 6,771,188 | B2 | 8/2004 | Flick | |
| 6,982,647 | B2 * | 1/2006 | Kuge et al. | 340/576 |
| 7,110,880 | B2 * | 9/2006 | Breed et al. | 701/207 |
| 7,215,254 | B2 * | 5/2007 | Tauchi | 340/903 |
| 7,274,306 | B2 * | 9/2007 | Publicover | 340/907 |
| 7,317,975 | B2 | 1/2008 | Woolford et al. | |

(Continued)

FOREIGN PATENT DOCUMENTS

JP 10-105880 4/1998

(Continued)

OTHER PUBLICATIONS

Delphion Search (Search Query: (((vehicle) <in> (Title,Abstract,Claims)) and ((wireless communication) <in> (Title,Abstract,Claims)) and (power conservation)), Oct. 17, 2007, 29 pages, retrieved from the Internet<URL:https://www.delphion.com/fcgi-bin/patsearch>.

(Continued)

*Primary Examiner* — Paul N Dickson
*Assistant Examiner* — Laura Freedman
(74) *Attorney, Agent, or Firm* — Patent Law Works LLP

(57) ABSTRACT

Historic vehicle state information specifying a plurality of performance values associated with the plurality of subsystems of the vehicle at a plurality of time points, including a current time point is stored at the vehicle. Historic neighbor vehicle state information specifying a plurality of performance values associated with a plurality of subsystems of a vehicle at a plurality of time points, including a current time point is received from a neighbor vehicle proximate to the vehicle. A forward-looking model is generated based on vehicle state information. An performance value associated with a subsystem of the plurality of subsystems of the vehicle is determined based on the historic vehicle state information, the historic neighbor vehicle state information, and the forward-looking model. A recommendation to a driver of the vehicle is provided based on the optimized performance value.

29 Claims, 21 Drawing Sheets

U.S. PATENT DOCUMENTS

| | | | | |
|---|---|---|---|---|
| 7,350,608 | B2 | 4/2008 | Fernandez | |
| 7,668,644 | B2 * | 2/2010 | Tengler et al. | 701/123 |
| 7,765,058 | B2 * | 7/2010 | Doering | 701/123 |
| 7,778,769 | B2 * | 8/2010 | Boss et al. | 701/123 |
| 7,783,417 | B2 * | 8/2010 | Vavrus | 701/200 |
| 7,791,503 | B2 * | 9/2010 | Breed et al. | 340/993 |
| 7,804,423 | B2 * | 9/2010 | Mudalige et al. | 340/902 |
| 7,805,223 | B2 * | 9/2010 | Yamaguchi et al. | 701/1 |
| 7,844,370 | B2 * | 11/2010 | Pollack et al. | 700/291 |
| 7,908,076 | B2 * | 3/2011 | Downs et al. | 701/117 |
| 2002/0120374 | A1 * | 8/2002 | Douros et al. | 701/29 |
| 2002/0152009 | A1 * | 10/2002 | Bartoli | 701/29 |
| 2004/0150516 | A1 | 8/2004 | Faetanini et al. | |
| 2004/0217852 | A1 | 11/2004 | Kolls | |
| 2005/0102074 | A1 | 5/2005 | Kolls | |
| 2005/0171660 | A1 | 8/2005 | Woolford et al. | |
| 2006/0089781 | A1 * | 4/2006 | Sato et al. | 701/103 |
| 2007/0035416 | A1 * | 2/2007 | Tanaka et al. | 340/906 |
| 2007/0051544 | A1 | 3/2007 | Fernandez | |
| 2007/0056185 | A1 * | 3/2007 | Isono | 34/493 |
| 2007/0083296 | A1 * | 4/2007 | Tengler et al. | 701/1 |
| 2007/0149184 | A1 | 6/2007 | Viegers et al. | |
| 2007/0216521 | A1 * | 9/2007 | Guensler et al. | 340/439 |
| 2007/0262855 | A1 * | 11/2007 | Zuta et al. | 340/439 |
| 2007/0282520 | A1 * | 12/2007 | Cradick et al. | 701/123 |
| 2008/0039957 | A1 * | 2/2008 | Hoseinnezhad | 700/44 |
| 2008/0133120 | A1 * | 6/2008 | Romanick | 701/123 |
| 2009/0037088 | A1 * | 2/2009 | Taguchi | 701/117 |
| 2009/0174573 | A1 * | 7/2009 | Smith | 340/905 |
| 2009/0228172 | A1 * | 9/2009 | Markyvech et al. | 701/36 |
| 2010/0057361 | A1 * | 3/2010 | Caveney et al. | 701/301 |
| 2010/0164753 | A1 * | 7/2010 | Free | 340/932 |
| 2010/0211247 | A1 * | 8/2010 | Sherony | 701/29 |

FOREIGN PATENT DOCUMENTS

| | | |
|---|---|---|
| JP | 2002-326525 | 11/2002 |
| JP | 2003-039975 | 2/2003 |
| JP | 2003-151091 | 5/2003 |
| JP | 2004-287672 | 10/2004 |
| JP | 2005-327250 | 11/2005 |
| JP | 2006-195641 | 7/2006 |

OTHER PUBLICATIONS

Delphion Search (Search Query: ((engine)and(control)and(wireless communication)and(vehicle)and(fuel efficiency)), Oct. 17, 2007, 46 pages, retrieved from the Internet<URL:https://www.delphion.com/fcgi-bin/patsearch>.

Delphion Search (Search Query: ((energy conservation) and (vehicle) and (wireless communication)), Oct. 17, 2007, 38 pages, retrieved from the Internet<URL:https://www.delphion.com/fcgi-bin/patsearch>.

Ireson, N., "Audi Starts Trial of Fuel-saving Travolution Traffic System," Sep. 19, 2008, Motor Authority, [Online] [Retrieved on Mar. 26, 2009] Retrieved from the Internet<URL:http://www.motorauthority.com/audi-reveals-travolution-eco-friendly-traffic-system.html>.

Thomas, D., "Audi Takes on Stop Lights: A Must Read", Jul. 22, 2008, Cars.com, [Online] [Retrieved on Mar. 26, 2009] Retrieved from the Internet<URL:http://blogs.cars.com/kickingtires/2008/07/audi-takes-on-s.html#more>.

* cited by examiner

MANAGING VEHICLE EFFICIENCY

BACKGROUND OF THE INVENTION

Modern vehicles are typically equipped with one or more computer systems. A vehicle computer system may simply be a processor that inputs certain signals, processes data carried by the input signals, and outputs signals that are used to control some aspect of the vehicle's use or operation. Typically, vehicle computer systems include not only a processor, but also memory or a storage device, and an output device. The output device can either be used to provide the driver with audio or visual instructions on how to operate the vehicle or may automatically control some aspect of the vehicle's operation such as the vehicle braking system, the air conditioning system or the engine.

Memory and/or storage devices associated with the vehicle store the received input and output signals. Input signals may be received from sensors which monitor the state of the vehicle. A modern automobile may have as many as 50 electronic control units (ECU) associated with vehicle sensors that monitor the function and health of the various subsystems of the vehicle. Most vehicles comprise an engine control unit. Additional electronic control units are associated with the vehicle's transmission, airbags, antilock braking, cruise control, audio systems, windows, mirror adjustment, etc. Modern vehicles are further equipped with sensors which provide data regarding the environment in which the vehicle is operating. Data provided by the sensors may be stored in the memory or storage associated with the vehicle.

In addition to sensors, the vehicle also receives input data using communications systems. Communications system may receive and transmit global positioning data and other types of data. Data and memory associated with the vehicle can be used to store the received global positioning system (GPS) data.

The combination of global positioning system data and sensor data allows the vehicle to store a "snapshot" of the current vehicle state information including vehicle sensor data, environmental sensor data and GPS data. The vehicle state information can be received and stored at different points of time providing a history of the vehicle's state information. However, even though modern vehicles have the capacity to record and use vehicle state information, this information has not been effectively used to optimize vehicle performance. Typically existing systems do provide a way to use the disparate information in a unified way. Further, historic vehicle state information is not shared by the vehicles with proximate or "neighboring" vehicles in order to collectively optimize vehicle performance.

SUMMARY OF THE INVENTION

The above and other needs are met by systems, methods and computer program products for improving the performance, in particular, the energy efficiency of a vehicle. In one embodiment, a vehicle comprises a wireless communications device, an on board data processing unit, a global positioning system and sensors. The on board data processing unit comprises an energy management system, a memory register and a lookup table. The energy management system is configured to receive and store historic vehicle state information, infrastructure state information and historic neighbor vehicle state information. The energy management system uses this information to create one or more forward-looking or predictive models. The forward-looking models are used by the energy management system to generate signals to control the operation of the vehicle or notify the driver signal.

The present invention includes a method for optimizing a performance of one or more subsystems associated with a vehicle. Historic vehicle state information specifying a plurality of performance values associated with the plurality of subsystems of the vehicle at a plurality of time points, including a current time point is stored at the vehicle. A vehicle forward-looking or predictive model is generated based on the historic vehicle state information. Historic neighbor vehicle state information specifying a plurality of performance values associated with a plurality of subsystems of the neighbor vehicle at a plurality of time points, including a current time point is received from a neighbor vehicle proximate to the vehicle. In one embodiment, the vehicle forward-looking model specifies relative weightings of the plurality of subsystems of the vehicle being associated with improved performance. A neighbor vehicle forward-looking or predictive model is generated based on the historic neighbor vehicle state information. In one embodiment, the neighbor vehicle forward-looking model specifies relative weightings of the plurality of subsystems of the neighbor vehicle being associated with improved performance the vehicle. An optimized performance value associated with a subsystem of the plurality of subsystems of the vehicle is determined based on the historic vehicle state information, the historic neighbor vehicle state information, and at least one of: the vehicle forward-looking model and the neighbor vehicle forward-looking model. In an alternate embodiment, a single unified forward-looking or predictive model based on at least one of historic vehicle state information, infrastructure state information and historic neighbor vehicle state information is created and used.

The features and advantages described herein are not all inclusive, and in particular, many additional features and advantages will be apparent to those skilled in the art in view of the following description. Moreover, it should be noted that the language used herein has been principally selected for readability and instructional purposes and may not have been selected to circumscribe the present invention.

Figure 1A:
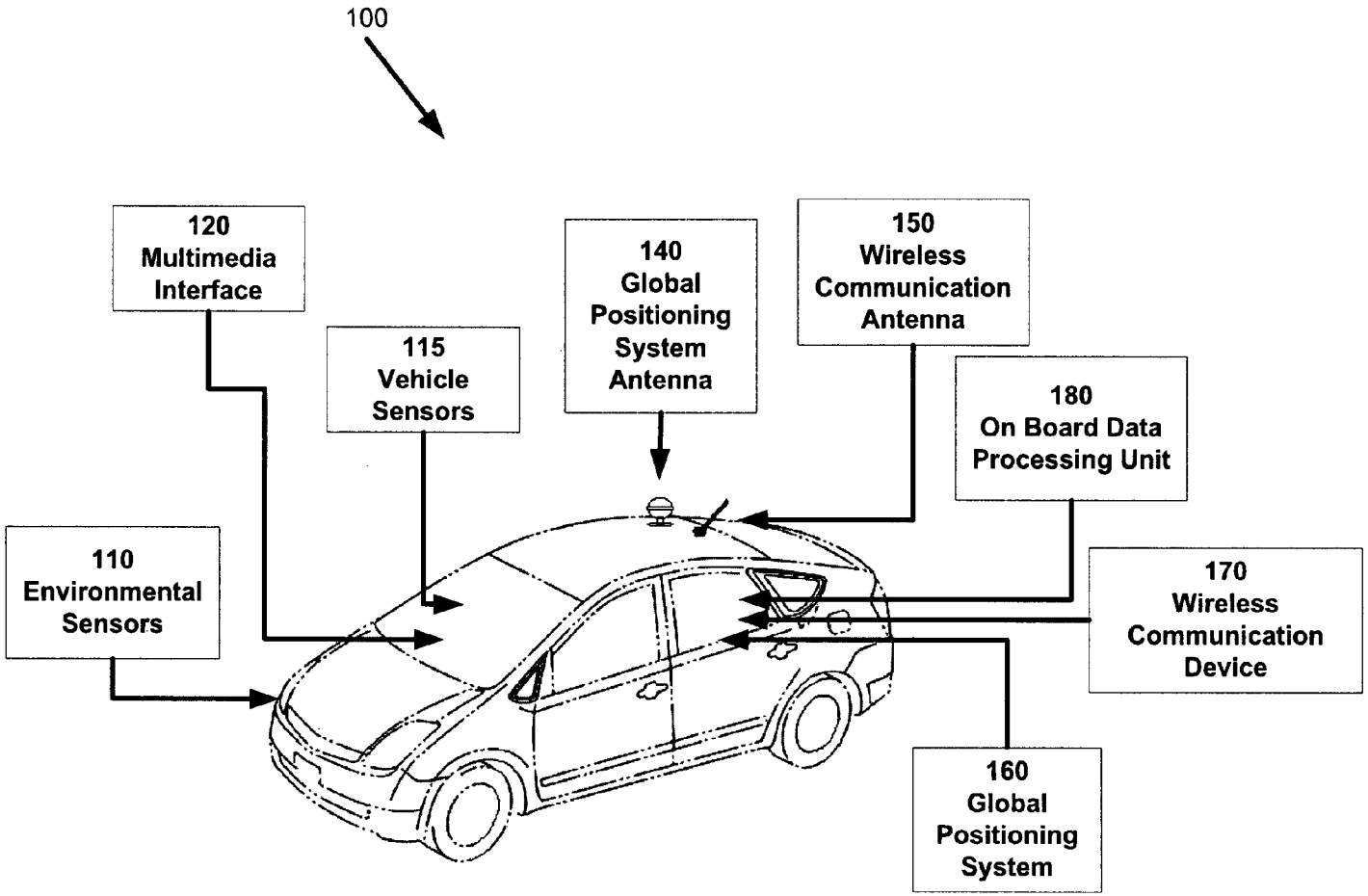
FIGS. 1A and 1B shows block diagrams of a vehicle in accordance with an embodiment of the present invention.

Each of the figures referenced above depict an embodiment of the present invention for purposes of illustration only. Those skilled in the art will readily recognize from the following description that one or more other embodiments of the structures, methods, and systems illustrated herein may be used without departing from the principles of the present invention.

DETAILED DESCRIPTION

Reference in the specification to "one embodiment" or to "an embodiment" means that a particular feature, structure, or characteristic described in connection with the embodiments are included in at least one embodiment of the invention. The appearances of the phrase "in one embodiment" in various places in the specification are not necessarily all referring to the same embodiment.

Some portions of the above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic or optical signals capable of being stored, transferred, combined, compared and otherwise manipulated. It is convenient at times, principally for reasons of common usage, to refer to these signals as bits, values, elements, symbols, characters, terms, numbers, or the like. Furthermore, it is also convenient at times, to refer to certain arrangements of steps requiring physical manipulations of physical quantities as modules or code devices, without loss of generality.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or "determining" or the like, refer to the action and processes of a computer system, or similar electronic computing device, that manipulates and transforms data represented as physical (electronic) quantities within the computer system memories or registers or other such information storage, transmission or display devices.

Certain aspects of the present invention include process steps and instructions described herein in the form of an algorithm. It should be noted that the process steps and instructions of the present invention can be embodied in software, firmware or hardware, and when embodied in software, can be downloaded to reside on and be operated from different platforms used by a variety of operating systems.

The present invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the present invention as described herein, and any references below to specific languages are provided for disclosure of enablement and best mode of the present invention.

While the invention has been particularly shown and described with reference to a preferred embodiment and several alternate embodiments, it will be understood by persons skilled in the relevant art that various changes in form and details can be made therein without departing from the spirit and scope of the invention.

Finally, it should be noted that the language used in the specification has been principally selected for readability and instructional purposes, and may not have been selected to delineate or circumscribe the inventive subject matter. Accordingly, the disclosure of the present invention is intended to be illustrative, but not limiting, of the scope of the invention, which is set forth in the following claims.

Figure 1B:
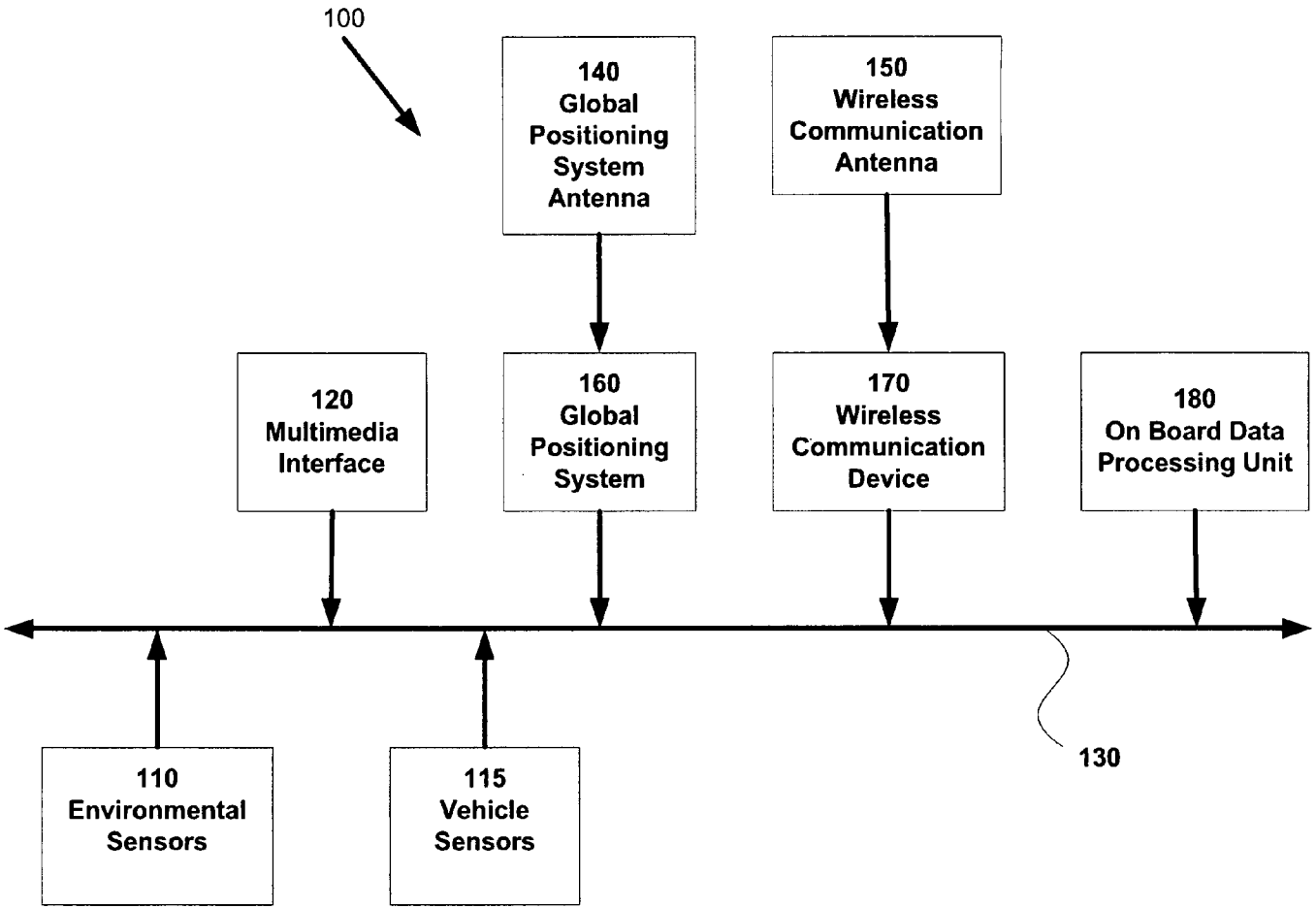

Referring now to FIGS. 1A and 1B, a vehicle 100 comprises a wireless communications antenna 150, a global positioning system antenna 140, a wireless communications device 170, an on board data processing unit 180, a global positioning system 160, environmental sensors 110 and vehicle sensors 115 coupled by a bus 130. In other embodiments, the vehicle 100 includes additional or alternate components such as a multimedia interface 120.

The vehicle 100 comprises communications components including a wireless communications antenna 150, a global positioning system antenna 140, a global positioning system 160 and a wireless communications device 170. The wireless communications device 170 transmits and receives Vehicle to Vehicle (V2V) Message Sets using the wireless communications antenna 150. The wireless communications device 170 is any one of a conventional type using the cellular network, 3G, WiMAX, Wi-Fi according to 802.11, or other wireless communication protocols. A V2V Message Set is a set of vehicle state information that the vehicle 100 transmits to its neighboring vehicles and receives from its neighboring vehicles. V2V Message Sets are described in detail below with respect to FIGS. 5 and 5*b*. The wireless communications device 170 further receives Infrastructure to Vehicle (I2V) Message Sets from roadside access unit 200 (See FIG. 2) using the wireless communications antenna 150. The roadside access unit 200 is a computing system having communications systems and sensors that are located by the side of the roads and other thoroughfares. Roadside access unit 200 is described in detail below with respect to FIG. 2. I2V Message Sets are described in detail below with respect to FIG. 6.

The vehicle 100 further comprises computing devices including an on board data processing unit 180 and a global positioning system 160. The on board data processing unit 180 computes information used to control the vehicle and/or issue driver notifications. The on board processing unit 180 is a computing device comprising one or more processors and a memory. In one embodiment, the on board data processing unit 180 is a central master controller that communicates with and controls the electronic control units (ECUs) (not shown) of the vehicle 100. For example, a typical vehicle includes tens or hundreds of ECUs controlling different aspects of the vehicle such as but not limited to the engine, power train, transmission, braking, cruise control, airbag, telephone, man machine interface, body control, door control, seat control, climate control, speed control, etc. The global positioning system 160 receives signals representing global positioning from the global positioning system antenna 140. The global positioning system 160 uses this information to calculate the location of the vehicle 100.

The vehicle 100 further comprises input devices such as environmental sensors 110 and vehicle sensors 115. The environmental sensors 110 monitor the air density, air quality, humidity and temperature of the environment external to the vehicle 100. According to one embodiment, the environmental sensors 110 are positioned on the interior or the exterior of the vehicle 100 depending on what they are measuring. In some embodiments, the environmental sensors 110 include a radar detection unit. The vehicle sensors 115 provide information about operation of the various subsystems of the vehicle 100. For example, the vehicle sensors 115 measure various aspects of operation of the vehicle such as braking, emissions, speed, tire pressure, transmission, climate control, lighting, engine operation such as fuel mix, value operation, etc. The environmental sensors 110 and vehicle sensors 115 coupled to the bus 130 for communication with the on board data processing unit 180.

The bus 130 couples the electronic components of the vehicle 100 for communication. In particular, FIG. 1B, shows an example configuration with the bus 130 coupling the wireless communications device 170, the on board data processing unit 180, the global positioning system 160, the environmental sensors 110, the vehicle sensors 115 and the multimedia interface 120. In one embodiment, the bus 130 is a Controller-Area Network (CAN or CAN-bus) designed to allow microcontrollers and devices to communicate with each other within the vehicle 100 without a host computer. The bus 130 provides communications between the vehicle sensors 115 in the ECU s that control the subsystems of the vehicle 100. For example, the bus 130 provide communications coupling between the engine control unit and the transmission, or to connect the door locks, climate control, seat control, etc. The on board data processing unit 180 uses the bus 130 to receive vehicle state data from the vehicle sensors 115, neighbor vehicle state information via the wireless communication device 170, position data via the global positioning system 160, and environmental data from the environmental sensors 110.

Figure 2:
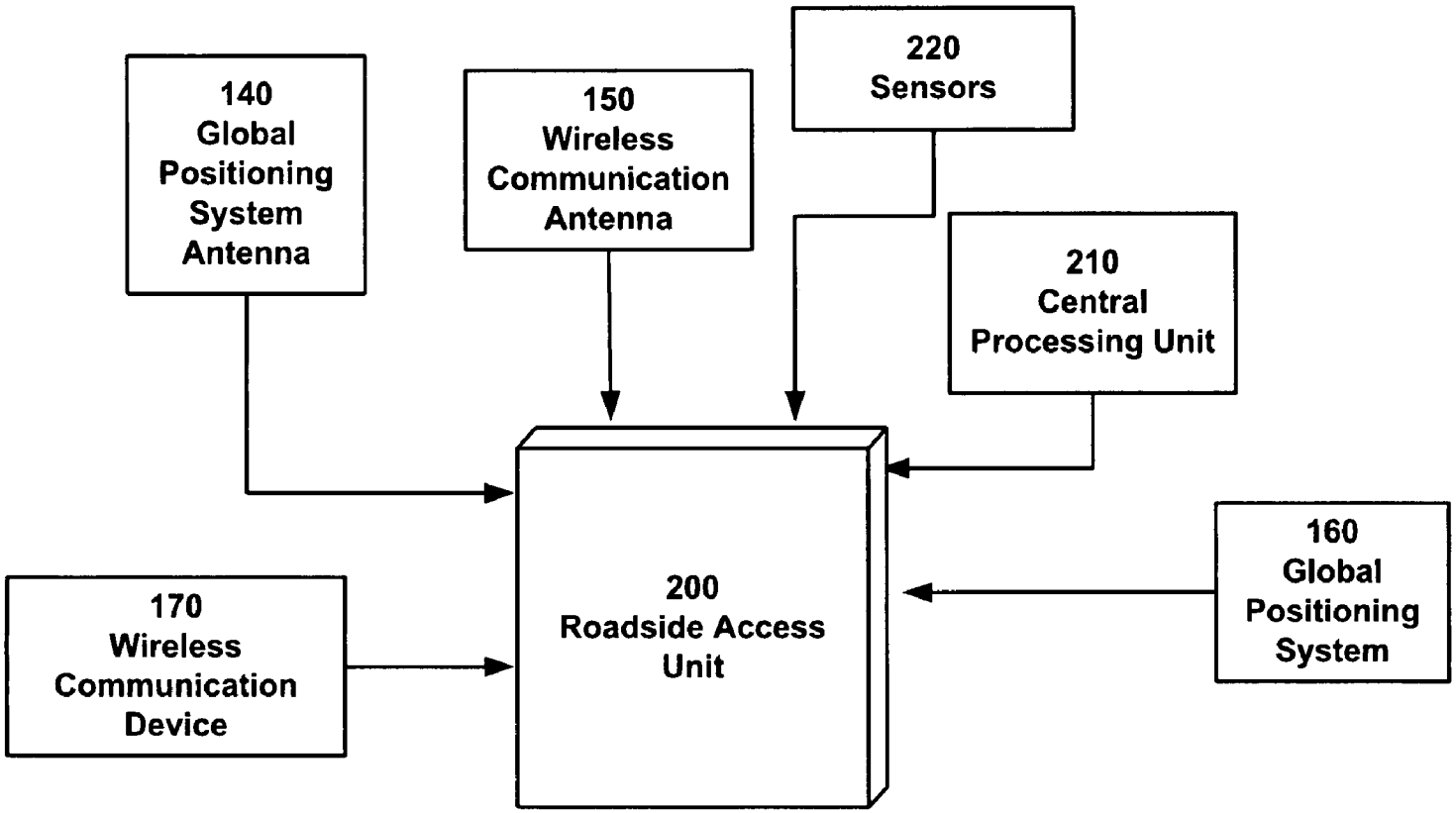
FIG. 2 shows a block diagram of a roadside access unit in accordance with an embodiment of the present invention.

FIG. 2 illustrates a roadside access unit 200 according to one embodiment. The roadside access unit 200 comprises a wireless communication device 170, a wireless communication antenna 150, a global positioning system antenna 140 and a global position system 160 that perform the same or similar functions described above with reference to the vehicle 100, but for roadside access unit 200. The roadside access unit 200 further comprises a central processing unit 210 and sensors 220. Embodiments of a system will comprise thousands or millions of roadside access units 200 and thousands or millions of vehicles 100. The roadside access units 200 are associated with a geographic position and a segment of a road or thoroughfare. Further, the wireless communication device 170 is also used in some embodiments to couple the roadside access unit 200 to a traffic control and information network (not shown) to retrieve information about infrastructure or traffic conditions.

Some roadside access units 200 are associated with an intersection such as an intersection controlled by a stop sign or an intersection controlled by a traffic light. Accordingly, the wireless communication devices 170 associated with the roadside access units 200 may receive traffic light signal phase information via the wireless communication antenna 150 and the wireless communication device 170. The roadside access units 200 transmit I2V Message Sets comprising infrastructure information such as road information, traffic light signal information, traffic and accident information, geographically specific driving information (e.g. speed limit) and other positional information to the vehicles 100.

Figure 3:
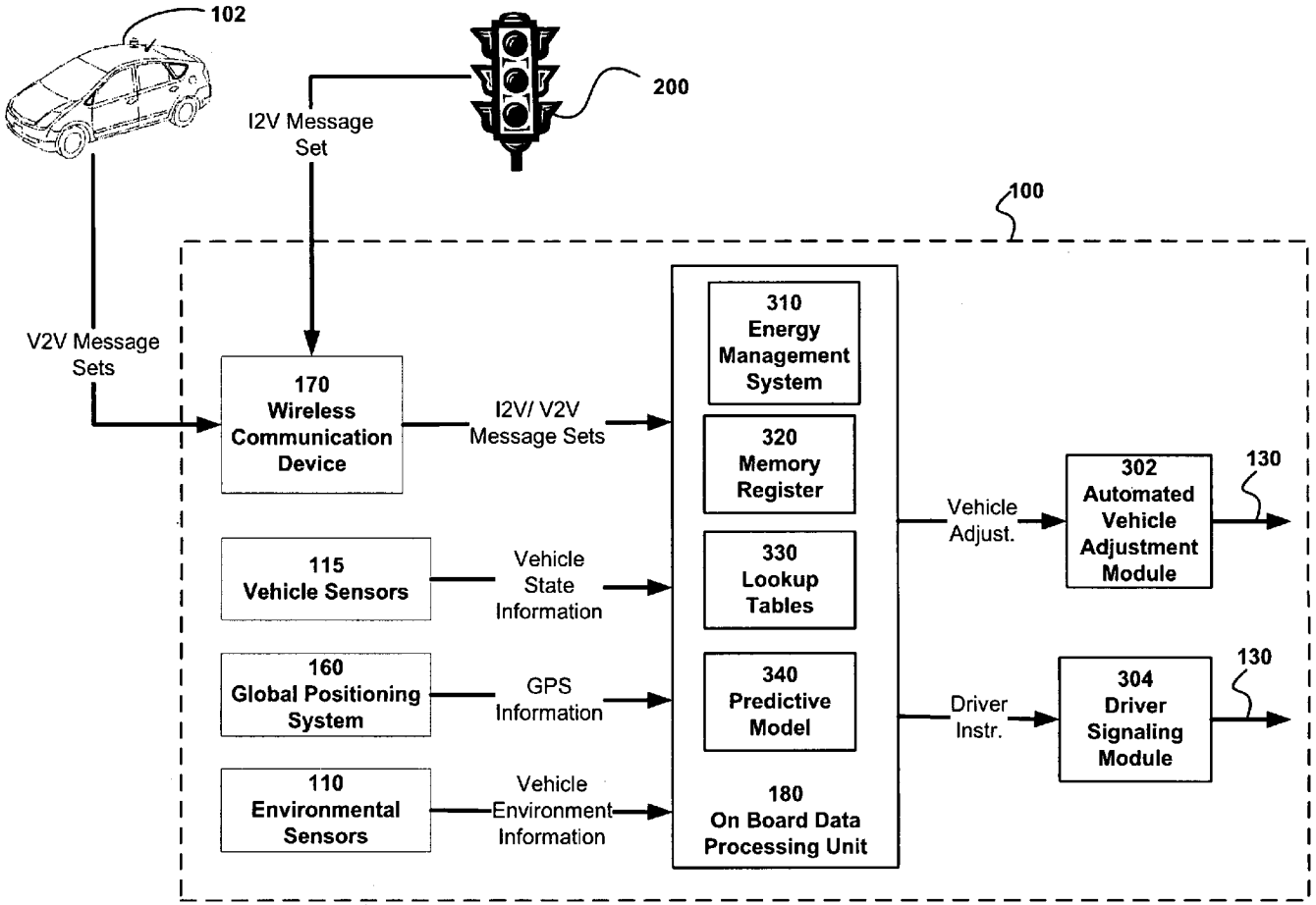
FIG. 3 illustrates a block diagram of the vehicle, a neighbor vehicle and the roadside access unit showing the transmission of information in accordance with an embodiment of the present invention.

FIG. 3 illustrates the data flow for information from the roadside access unit and a neighbor vehicle 202 to the vehicle 100. FIG. 3 also shows the data flow of information from the wireless communications device 170, the environmental sensors 110, the vehicle sensors 115, and the global positioning system 160 to the on board data processing unit 180. Finally, FIG. 3 shows the data flow from the on board data processing unit 180 to the automated vehicle adjustment module 302 and the driver signaling module 304, and then on to the bus 130 for transmission to ECUs (not shown).

The on board data processing unit 180 comprises an performance or energy management system 310 which functions to analyze received information in order to generate information used to control the vehicle 100. While the present invention will now be described with reference to energy management and efficiency, those skilled in the art will recognize that the performance or energy management system 310 may be a management system that improves the performance of any subsystem of the vehicle 100, and that such embodiments have similar functionality as described below, but directed toward improving a different performance aspect of the vehicle 100. The energy management system 310 communicates with the memory register 320 and one or more lookup tables 330 to store and retrieve historic vehicle state information stored in the memory register 320 and/or one or more lookup tables 330. The memory register 320 and lookup tables 330 comprise one or more computer-readable storage areas associated with the on board data processing unit 180. The memory register 320 is used by the energy management system 310 to store historic vehicle state information associated with the vehicle 100, historical neighbor vehicle state information received in V2V Message Sets from neighbor vehicles and infrastructure state information received in I2V Message Sets. The lookup tables 330 are working memory used by the energy management system 310 to store temporary variables used in computations. The energy management system receives the infrastructure state information and historic neighbor vehicle state information via the wireless communications device 170.

The energy management system 310 receives environment information from and is coupled to the environmental sensors 110. The energy management system 310 further receives global positioning information from and is coupled to the global positioning system 160. The energy management system 310 further receives information describing the state and function of one or more subsystems of the vehicle 100 from and is coupled to the vehicle sensors 115.

The energy management system 310 receives V2V Message Sets and I2V Message Sets from the wireless communication device 170. The wireless communication device 170 receives V2V Message Sets from neighboring vehicles 102. The wireless communications device 170 receives I2V Message Sets from roadside access units 200. The energy management system 310 stores the V2V Message Sets and I2V Message Sets in the memory register 320 in association with timestamps indicating when the V2V Message Sets and I2V Message Sets were received. Data transmitted in the V2V Message Sets are described in detail below with regard to FIGS. 5*a* and 5*b*. Data transmitted in the I2V Message Sets are described in detail below with regards to FIG. 6.

The energy management system 310 analyzes the historic vehicle state information, historic neighbor vehicle state information, infrastructure state information and environmental information stored in the memory register 320 to optimize values associated with one or more subsystems of the vehicle 100 according to heuristics such as energy efficiency, safety, vehicle "wear and tear" and travel time. The energy management system 310 generates one or more forward looking or predictive models 340 for the vehicle 100 and the neighbor vehicles 102 based on the historic vehicle state information and the historic neighbor vehicle state information, infrastructure state information, environmental information etc. In one embodiment, the forward looking or predictive models 340 are stored in storage 340 associate with or part of the on board data processing unit 180. The energy management system 310 modifies current vehicle state information and environmental information based on the forward looking or predictive models 340 associated with the vehicle 100 and/or the neighbor vehicle 102 In one embodiment, the forward-looking model specifies a relative weighting of the plurality of subsystems of the vehicle being associated with improved performance.

The energy management system 310 uses the optimized values and/or the forward looking or predictive models 340 to control the vehicle 100 by generating a signal to automatically adjust one or more subsystems of the vehicle 100. In one embodiment, the automated vehicle adjustment module 302 is coupled to receive signals from the on board data processing unit 180 and convert them to signals addressed to and for controlling the appropriate ECU. The automated vehicle adjustment module 302 has an input coupled to an output of the on board data processing unit 180 and an output coupled to bus 130. In another embodiment, the automated vehicle adjustment module 302 is routines executable by the on board data processing unit 180, and the on board data processing unit 180 uses existing couplings to the bus 130 to send control signals to the ECUs.

The energy management system 310 further uses the optimized values and/or the forward looking or predictive models 340 to provide instructions to a driver of the vehicle 100. In some embodiments, the energy management system 310 weights or determines the optimized values according to personalization settings provided by a driver of the vehicle 100. Personalization settings can include a value which specifies a degree of optimization. According to the embodiment, the value that specifies the degree of optimization can be a continuous value such as a percentage optimization value (i.e. 0-100% optimization) or a categorical value (e.g. low optimization, medium optimization, high optimization). In some embodiments, several values that specify the degree of optimization may be provided by the driver of the vehicle 100 in association with optimization heuristics such as efficiency, safety, vehicle "wear and tear" and travel time. In one embodiment, the driver signaling module 304 is coupled to receive signals from the on board data processing unit 180 and convert them to instructions for presentation to the driver either visually or audibly. The automated vehicle adjustment module 302 has an input coupled to an output of the on board data processing unit 180 and an output coupled by bus 130 to the ECU of the man machine interface. In another embodiment, the driver signaling module 304 is routines executable by the on board data processing unit 180, and the on board data processing unit 180 uses existing couplings to the bus 130 to send control signals to the man machine interface ECU.

Responsive to the optimized values, the energy management system 310 transmits output signals to automatically adjust subsystems of the vehicle 100 to the automated vehicle adjustment module 302. In an alternate embodiment, the energy management system 310 directly controls the ECUs using bus 130. The energy management system 310 further provides the driver of the vehicle 100 with audio, tactile and/or visual instructions to control the vehicle 100 using the automated vehicle adjustment module 302 responsive to the optimized values. In some embodiments, the energy management system 310 may provide tactile instructions to control the vehicle 100 using bus 130 to directly control the subsystem of the vehicle 100. For instance, tactile instructions to accelerate may be provided to the driver through the gas pedal or tactile instructions to apply force to the braking system may be provided to the driver through a hapatic braking system.

This approach to vehicle optimization is beneficial as it allows for the integration of numerous complimentary sources of information to optimize vehicle performance based on heuristics such as fuel efficiency, drive time and safety. Historic vehicle state information is compiled from GPS data, data received from environmental sensors 110 and vehicle subsystem data received from the vehicle sensors 115 in order to optimize vehicle performance. This approach further uses forward looking or predictive models derived from the historic vehicle state information (e.g. driving behaviors, route information, gas consumption information) and infrastructure state information or neighbor vehicle information to optimize vehicle performance. This historic vehicle state information is reciprocally shared with neighboring vehicles in order to collectively optimize the performance of the group of neighboring vehicles.

In one embodiment, historic vehicle state information is further combined with information received from roadside access units 200, infrastructure state information, describing intersections and road conditions. The information received from roadside access units 200 provides a location-specific context for the optimization of the vehicle performance.

Figure 4:
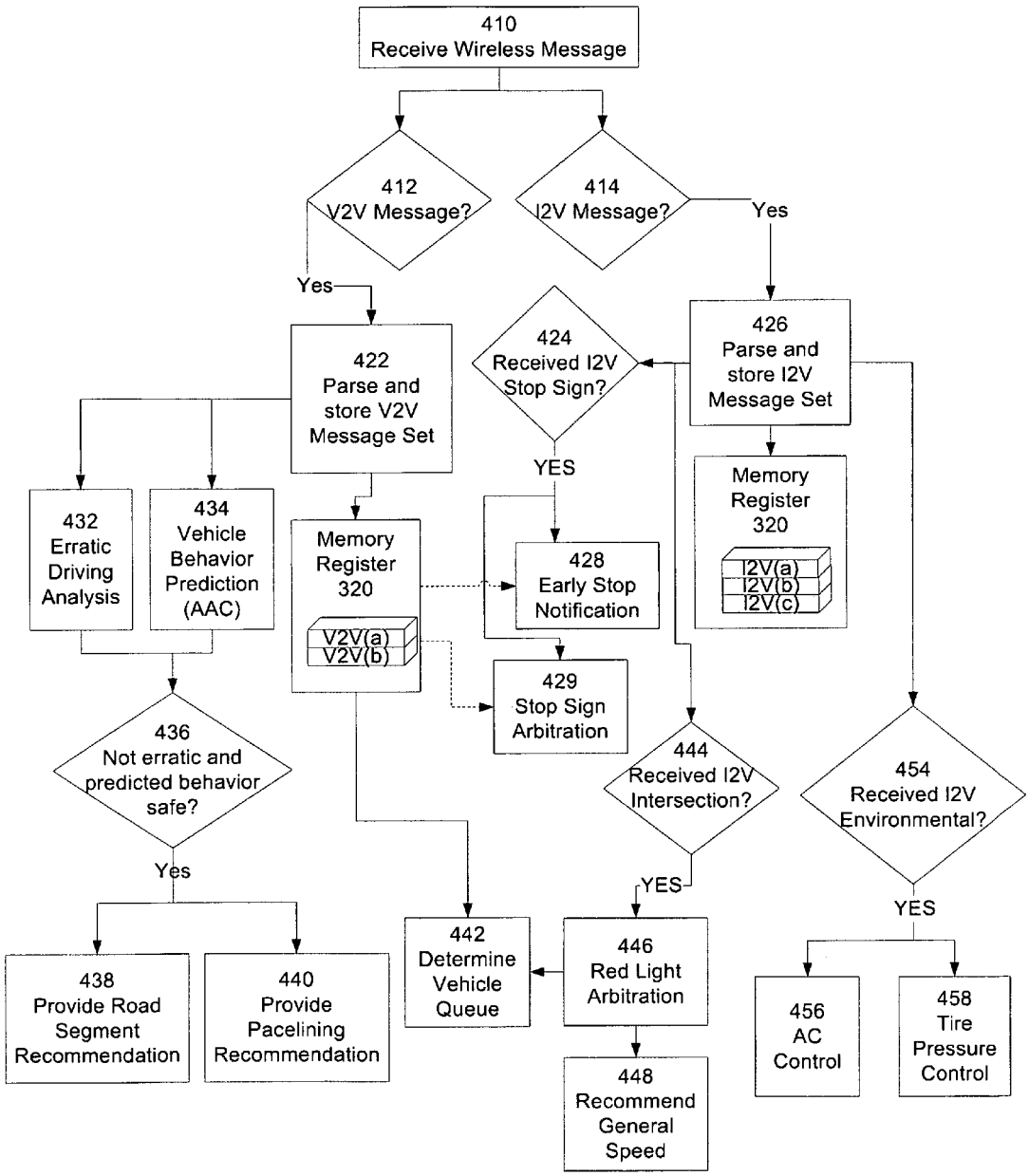
FIG. 4 is a flow chart illustrating steps performed by the energy management system to receive and process message sets in accordance with an embodiment of the present invention.

FIG. 4 is a flow chart illustrating steps performed by the energy management system 310 to receive and process V2V Message sets and/or I2V Message Sets.

The energy management system 310 receives 410 a message set from the wireless communications device 170. The energy management system 310 determines 412 whether the received message set is a Vehicle to Vehicle (V2V) Message Set or an Infrastructure to Vehicle (I2V) Message Set. If the message is not a Vehicle to Vehicle (V2V) Message Set and not an Infrastructure to Vehicle (I2V) Message Set, the process is complete and ends.

If energy management system 310 determines 412 the received message is a V2V Message Set from a neighboring vehicle 102, the energy management system 310 parses 422 the V2V Message Set to identify the neighbor vehicle state information contained in the message set. The energy management system 310 also stores the Message Set and update the memory register 320. The energy management system 310 performs 432 an erratic driving behavior analysis using the neighbor vehicle state information in order to determine whether the neighbor vehicle state information indicates that the other vehicle 100 is driving erratically. Erratic driving behavior analysis is discussed in detail below with respect to FIG. 15. The energy management system 310 further performs 434 vehicle behavior prediction based on predicted Associated Action Codes (AACs) to determine future behavior of the vehicle 100. Vehicle behavior prediction is discussed in detail below with respect to FIG. 14. Next, the method determines 436 whether the driving behavior neighboring vehicle is NOT erratic and the predicted behavior of the neighboring vehicle satisfies constraints. If energy management system 310 does determines 436 the neighboring vehicle driving behavior not to indicate erratic driving and the predicted behavior of the neighboring vehicle satisfies constraints provided that define safe driving behavior, then the energy management system 310 provides 438 instructions recommending a road segment to the driver and/or provides 440 instruction recommending pace-lining with the neighboring vehicle to the driver.

If the energy management system 310 determines 414 that the received Message Set is an I2V Message Set received from a roadside access unit 200, the energy management system 310 parses 426 the I2V Message Set to determine a type of infrastructure information included in the Message Set. The energy management system 310 also stores the Message Set and updates the memory register 320. In one embodiment, the types of infrastructure information include stop sign information, intersection information and environmental information. The method continues in steps 424, 444 and 454 to determine the type of information in the Message Set.

In step 424, the method determines whether the Message Set includes stop sign information. If not the processing is complete and ends. If the energy management system 310 determines 424 that the received I2V Message Set includes stop sign information, the energy management system 310 retrieves vehicle state information and neighbor vehicle state information from the memory register 320. Based on the retrieved information, the energy management system 310 provides 428 an early stop notification and performs 429 stop sign arbitration. Early stop notification and stop sign arbitration are discussed in detail below with respect to FIG. 17.

In step 444, the method determines whether the Message Set includes intersection information. If not the processing is complete and ends. If the energy management system 310 determines 444 that the received I2V Message Set includes intersection information, the energy management system 310 performs 446 red light arbitration for the next red traffic light that the vehicle 100 is approaching. Red light arbitration is described in detail below with respect to FIG. 7. The energy management system 310 then recommends 448 a general speed to the driver. The energy management system 310 also stores vehicle state information received from other vehicles from the memory register 320 to update 442 the vehicle queue. (e.g., after either step 422 or 446).

In step 454, the method determines whether the Message Set includes environmental information. If not the processing is complete and ends. If the energy management system 310 determines 454 that the received I2V Message Set includes environmental information, the energy management system 310 determines information used to control 456 the air conditioning unit and information used to control 458 the tire pressure and generates commands to control those functions. Controlling the air conditioning unit is described in detail below with respect to FIG. 13. Controlling the tire pressure is described in detail below with respect to FIGS. 11 and 12.

Figure 5A:
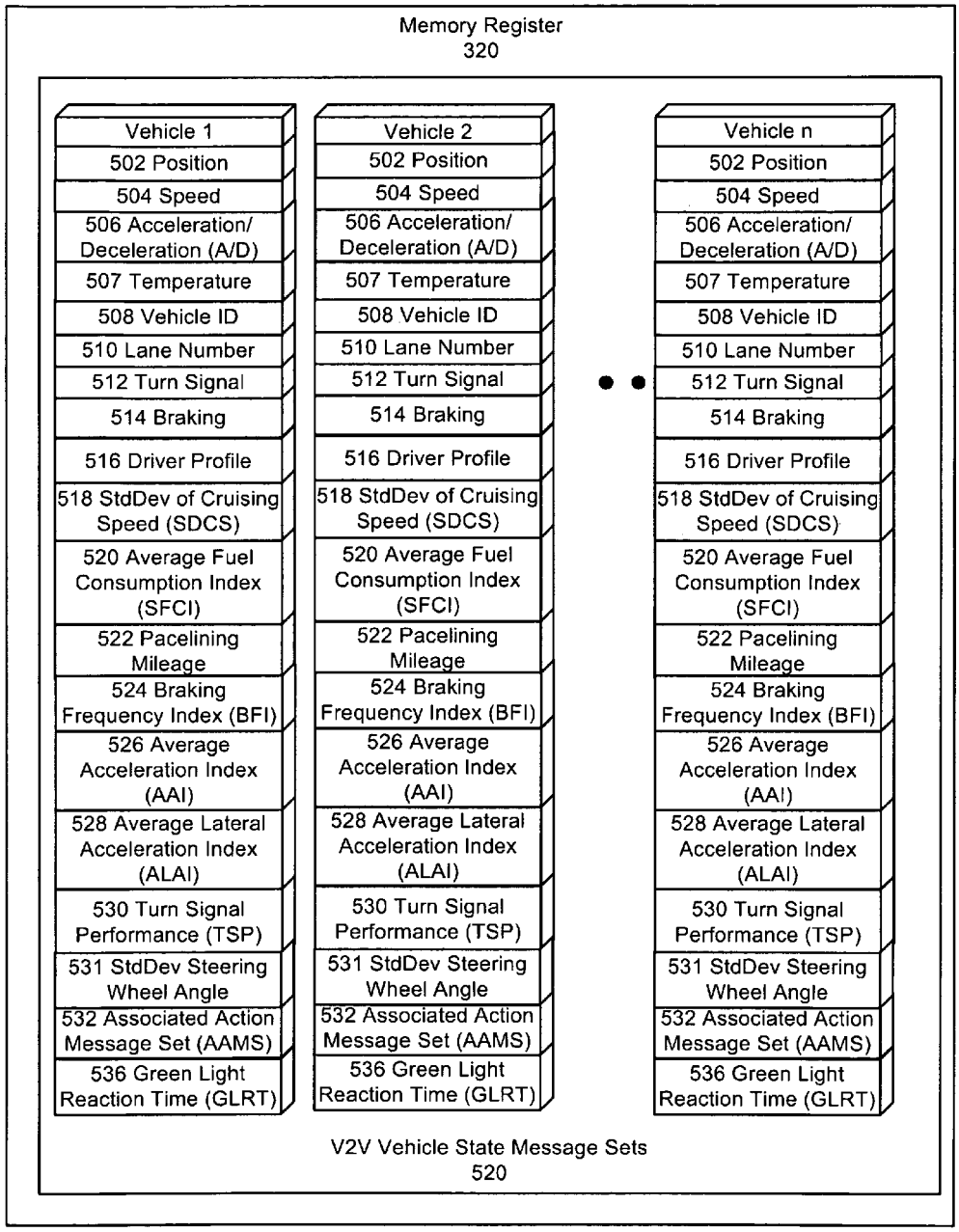
FIGS. 5*a* and 5*b* are high level block diagrams illustrating an example of the memory register including information included in the Vehicle to Vehicle (V2V) Message Sets in accordance with an embodiment of the present invention.
Figure 5B:
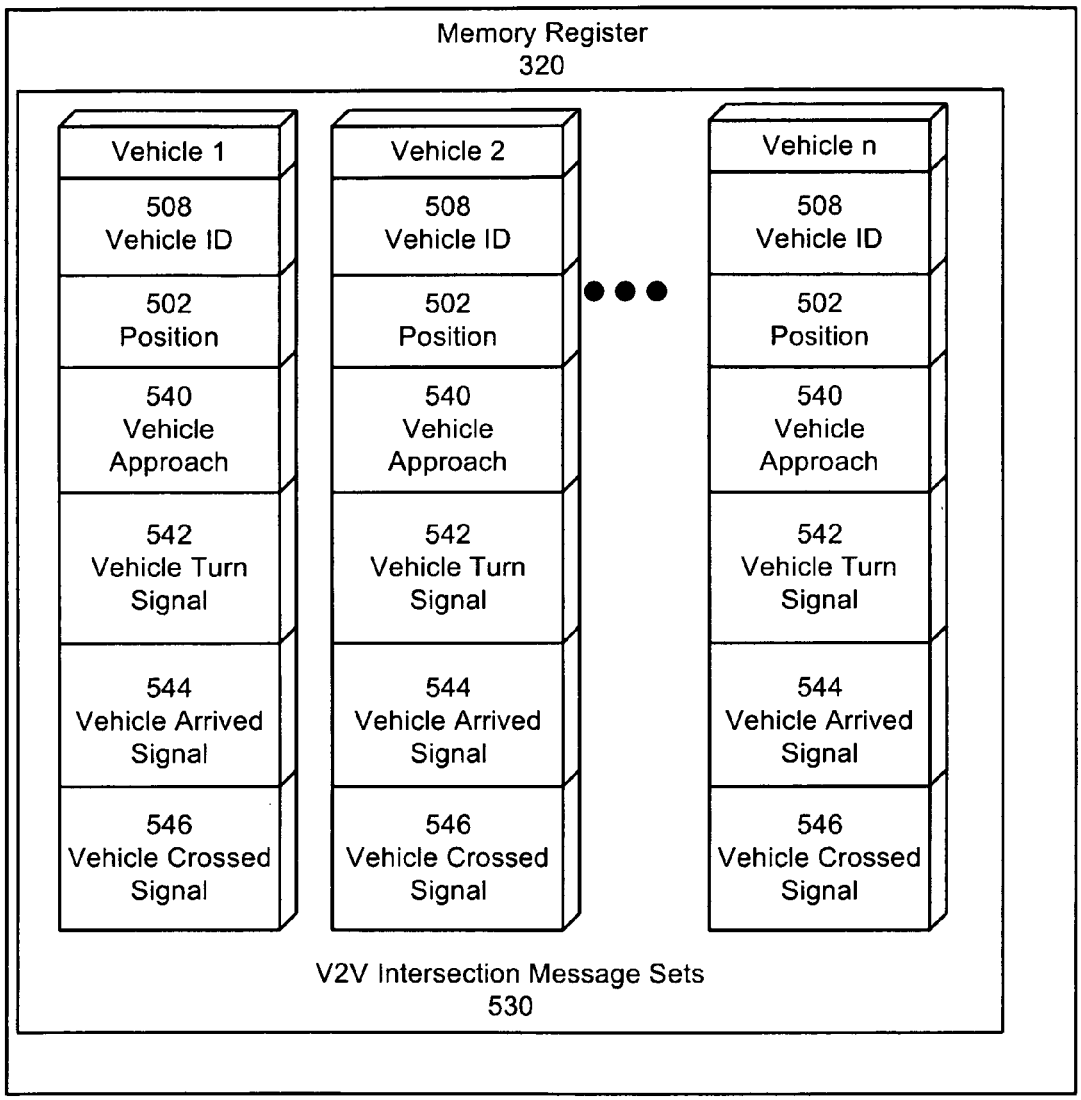

FIGS. 5*a* and 5*b* are high level block diagrams illustrating examples of information transmitted in the V2V Message Sets. FIG. 5*a* illustrates information transmitted in the V2V Vehicle State 520 Message Set. FIG. 5*b* illustrates information transmitted in the V2V Intersection Message Set 530.

FIG. 5*a* illustrates information transmitted and/or received in V2V Vehicle State Message Sets 520 according to one embodiment. In the embodiment illustrated, V2V Vehicle State Message Sets 520 are received from neighboring vehicles 102 1 through n and stored in the memory register 320 associated with the vehicle 100. V2V Vehicle State Message Sets 520 are also transmitted from the vehicle 100 to the neighboring vehicles 102. The V2V Vehicle State Message Set 520 includes: a position 502 determined by the global positioning system, the speed (velocity) 504 at which the vehicle 100 is travelling, a rate of acceleration or deceleration 506 of the vehicle 100, a vehicle ID 508 specifying a unique identifier for the vehicle 100, a lane number 510 indicating the lane the vehicle 100 is in, turn signal information 512 indicating whether the vehicle 100 is signaling to turn, braking information 514 indicating a force at which the vehicle is braking (including no braking), a driver profile 516 associated with the vehicle 100, a standard deviation of the cruising speed 518 of the vehicle, an index 520 of the average fuel consumption of the vehicle 100, the pacelining mileage 522 of the vehicle, an index 524 of barking frequencies associated with the vehicle 100, an index 526 of the average acceleration of the vehicle 100, an index 528 of the average lateral acceleration of the vehicle 100, turning signal performance information 530, an associated action message set 532 specifying an action the vehicle 100 is performing and a green light reaction time 536 of the vehicle.

FIG. 5*b* illustrates an example of information transmitted and/or received in V2V Intersection Message Sets 530 according to one embodiment. In the embodiment illustrated, the V2V Intersection Message Sets 530 are received from neighboring vehicles 102 1 through n and stored in the memory register 320 associated with a vehicle 100. V2V Intersection Message Sets 530 are also transmitted from the vehicle 100 to the neighboring vehicles 102. The V2V Intersection Message Set 530 includes a vehicle ID 508, the position 504 associated with the vehicle 100, information 540 indicating an angle of the vehicle's 100 approach, information 542 indicating the vehicle's 100 turn signal status, information 544 indicating whether the vehicle 100 has arrived at the intersection and information 546 indicating whether the vehicle 100 has crossed the intersection.

Figure 6:
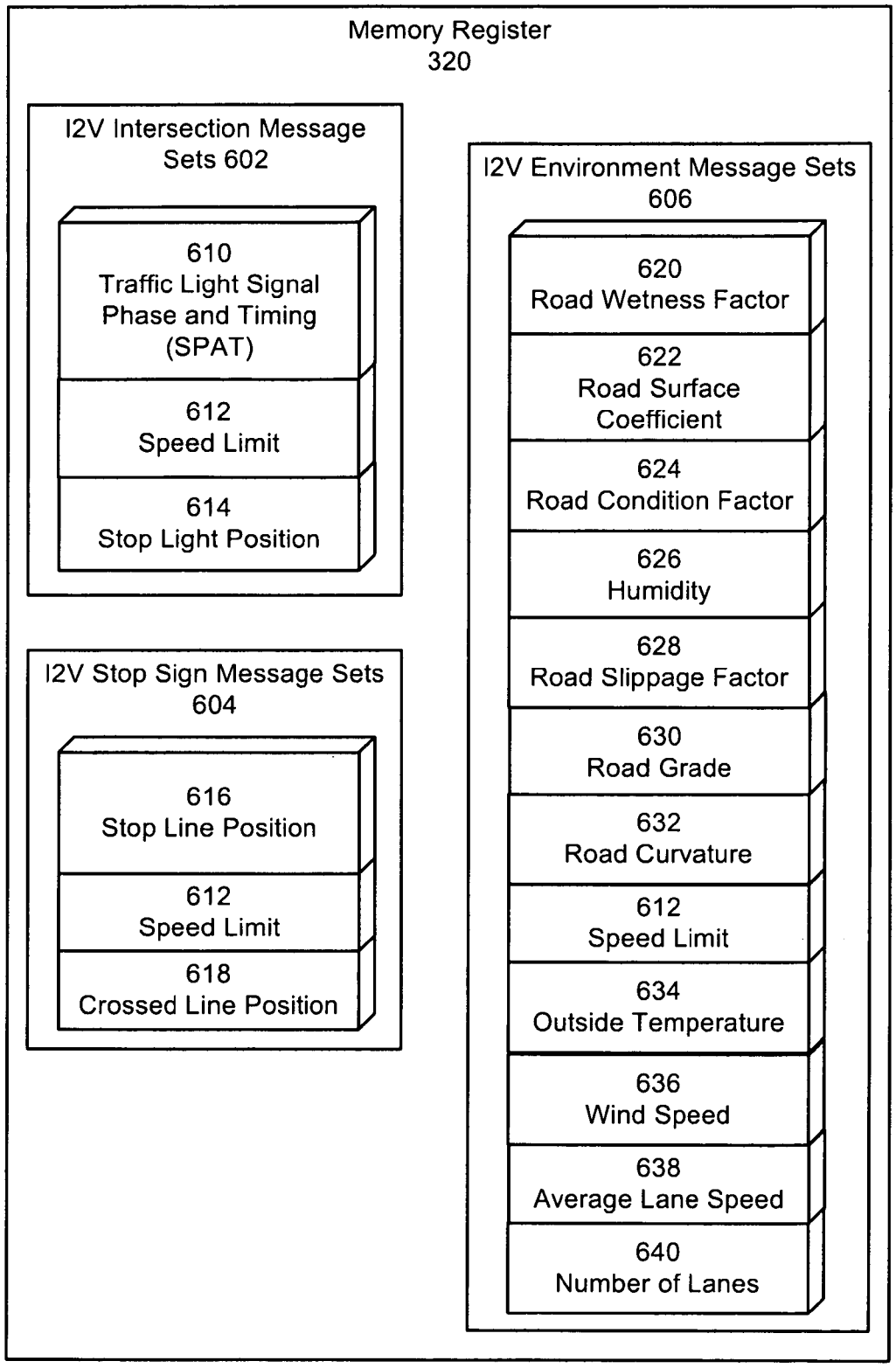
FIG. 6 is a high level block diagram illustrating another example of the memory register including information included in the Infrastructure to Vehicle (I2V) Message Set in accordance with an embodiment of the present invention.

FIG. 6 is a high-level block diagram illustrating information transmitted and/or received in the I2V Message Sets according to one embodiment. In the illustrated embodiment, the memory register 320 stores information received as one of an I2V Intersection Message Set 602, an I2V Stop Sign Message Set 604 and an I2V Environment Message Set 606 from one or more roadside access units 200 and stored in the memory register 320.

Intersection information is received in an I2V Intersection Message Set 602 from a roadside access unit 200 and stored in the memory register 320. The intersection information includes Traffic Light Signal Phase and Timing (SPAT) 610 information, a speed limit 612 associated with the geographic location of the roadside access unit 200 and the geographic co-ordinates specifying the position 614 of the stop light. The SPAT information 610 specifies the current phase a traffic light controlling an intersection is in (i.e. red, green, yellow) and the corresponding directions if necessary, the different phases associated with the traffic light, the amount of time spent in each phase. According to the type of traffic light, the time spent in each phase may vary depending on traffic/flow and or time of day.

Stop sign information is received in an I2V Stop Sign Message Set 604 from a roadside access unit 200 and stored in the memory register 320. The stop sign information includes a speed limit 612 associated with the geographic location of the roadside access point 200, geographic co-ordinates specifying the position 616 of vehicle arriving at the stop sign and geographic co-ordinates specifying the position 618 of vehicle crossing the line of the intersection controlled by the stop sign.

Environmental information is received in an I2V Environment Message Set 606 from a roadside access unit 200 and stored in the memory register 320. The environmental information includes information associated with the road proximate to the roadside access unit 200 including: a factor 620 indicating a level of wetness of the road, a coefficient 622 indicating a level of friction associated with the road surface, a factor 624 indicating the condition of the road, a factor 628 indicating a level of slippage associated with the road, a grade 630 of the road, a curvature 632 of the road, an average lane speed 638 and a number of lanes 640. The environmental information further includes a speed limit 612, the humidity 626, the outside temperature 634 and a measure 636 of the wind speed associated with the geographic location of the roadside access unit 200.

Below with reference to FIGS. 7-17, the methods of the present invention will be described. Those skilled in the art will recognize that other embodiments perform the illustrated steps in different orders, and/or perform different or additional steps. Moreover, in other embodiments some of the steps are performed by engines or modules other than the energy management system 310.

Figure 7:
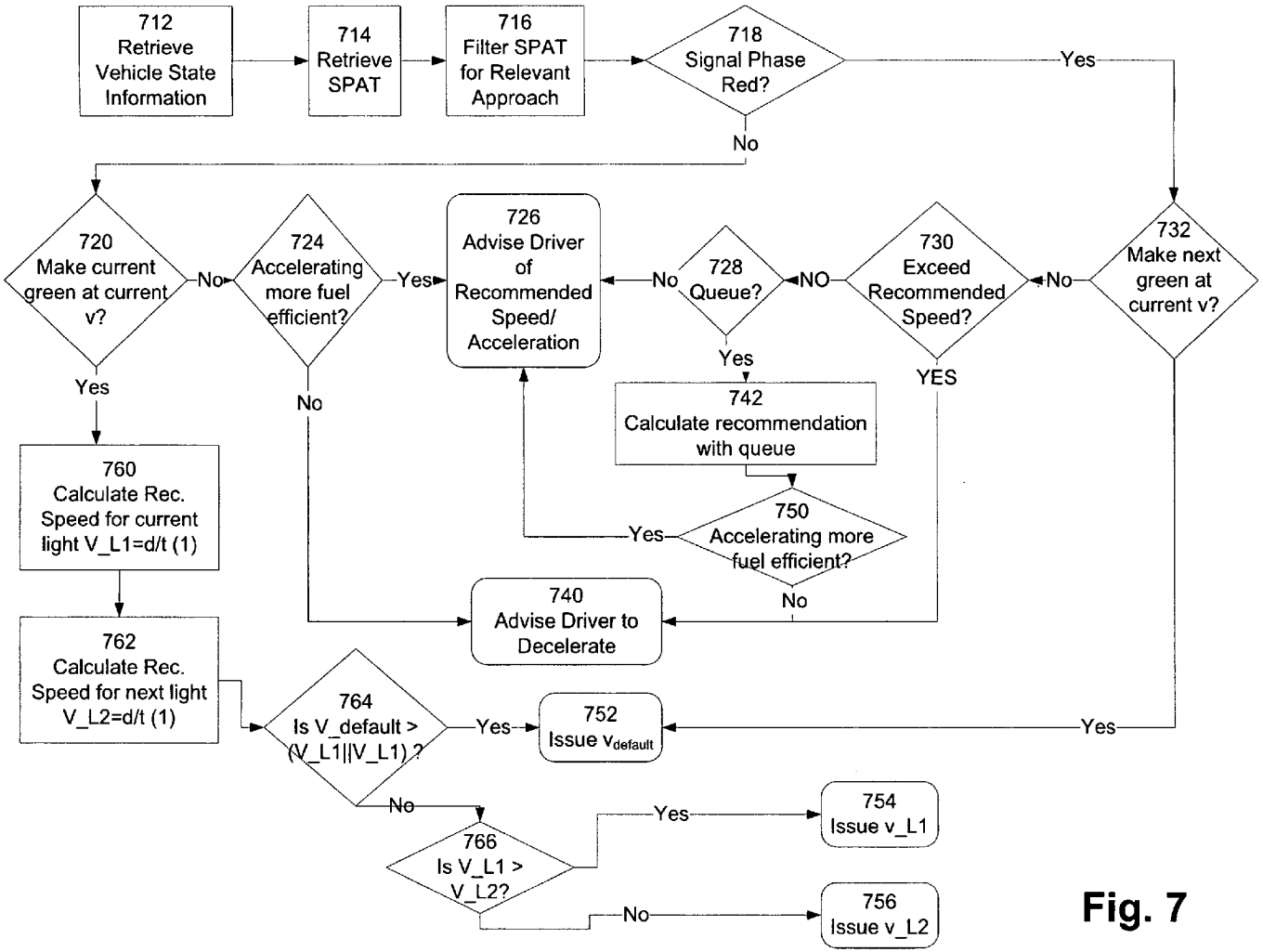
FIG. 7 is a flow chart illustrating steps performed by the energy management system to determine a recommended speed for the vehicle in accordance with an embodiment of the present invention.

FIG. 7 is a flow chart illustrating steps performed by the energy management system 310 to determine a recommended speed for the vehicle 100 according to one embodiment. The energy management system 310 retrieves 712 vehicle state information including turn signal information 512 from the memory register 320. The energy management system 310 retrieves 714 SPAT information 610 associated with an intersection received in an I2V Message Set and stored the memory register 320. The energy management system 310 filters 716 the SPAT information 610 for signal phase information relevant to the vehicle's position 502 at the intersection. The energy management system 310 determines 718 whether the traffic signal relevant to the vehicle's position 502 is red.

If energy management system 310 determines 718 that the traffic signal is not red, the energy management system 310 next determines 720 whether the vehicle 100 can make the current green light at the intersection based on timing information specified in the SPAT information 610 and the vehicle's current speed 504. If the energy management system 310 determines 720 that the vehicle 100 cannot make the current green light, the energy management system 310 determines 724 whether accelerating or decelerating the vehicle 100 is more fuel efficient based on a forward-looking or predictive model 340 of vehicle acceleration costs which is based on historic fuel efficiency data derived from the historic vehicle state information. In an alternate embodiment, the historic vehicle state information is modified based upon the past infrastructure information such as by making the light state/condition affect historic costs associated with environmental conditions of speed and acceleration. If the energy management system 310 determines 724 that accelerating the vehicle 100 is more fuel efficient, then the energy management system 310 generates a signal and sends it to an human interface unit to produce an advisory messages (either audible or visual) that advises 726 the driver of a recommended speed or acceleration. If the energy management system 310 determines 724 that decelerating the vehicle 100 is more fuel efficient, then the energy management system 310 generates a signal and sends it to an human interface unit to produce an advisory messages that advises 740 the driver to decelerate the vehicle 100.

If the energy management system 310 determines in step 720 that the vehicle 100 can make the current green light at the vehicle's current speed 504, the energy management system 310 calculates 760 a recommended speed for the current light (V_L1). The energy management system 310 calculates 762 a recommended speed for the next light (V_Ls) based on the timing information specified in the SPAT information 610.

The energy management system 310 next determines 764 whether the vehicle's current speed 504 (V_default) is greater than the recommended speed for the current light (V_L1) or the recommended speed for the next light (V_L2). If the energy management system 310 determines 764 that the vehicle's current speed 504 is greater than the recommended speed for the current light (V_L1) or the recommended speed for the next light (V_L2), the energy management system 310 issues 752 the vehicle's current speed 504 as the default speed and the method is complete.

If the energy management system 310 determined 764 that the vehicle's current speed 504 is not greater than the recommended speed for the current light (V_L1) or the recommended speed for the next light (V_L2), the energy management system 310 determines 766 whether the recommended speed for the current light (V_L1) is greater than the recommended speed for the next light (V_L2). If the energy management system 310 determined 766 that the recommended speed for the current light (V_L1) was greater than the recommended speed for the next light (V_L2), the energy management system 310 issues 754 the recommended speed for the current light (V_L1). If the energy management system 310 determined 766 that the recommended speed for the next light (V_L2) was not greater than the recommended speed for the current light (V_L1), the energy management system 310 issues 756 the recommended speed for the next light (V_L2).

If in step 718, the signal phase was determined to be red, the energy management system 310 determines 732 whether the vehicle 100 can make the next green light at the next intersection based on timing information specified in the SPAT information 610 and the vehicle's current speed 504. If the energy management system 310 determines 732 that the vehicle 100 can make the next green light at the next intersection based on the vehicle's current speed 504, the energy management system 310 issues 752 a default speed or behavior for the vehicle 100 and the method is complete.

If the energy management system 310 determines in step 732 that the vehicle 100 cannot make the next green light at the next intersection based on the vehicle's current speed 504, the energy management system 310 determines 730 whether the vehicle's current speed 504 exceeds a recommended speed. If the vehicle's energy management system 310 determined 730 that the vehicle's current speed 504 exceeds the recommended speed, the energy management system 310 advises 740 the driver to decelerate, for example, using the driver signaling module 304.

If the energy management system 310 determines 730 that the vehicle's current speed 504 does not exceed the recommended speed, the energy management system 310 determines 728 whether the vehicle 100 is in a queue of vehicles. If the energy management system 310 determines 728 that the vehicle 100 is not in a queue of vehicles, the energy management system 310 advises 726 the driver of a recommended speed or level of acceleration.

If the energy management system 310 determines 728 that the vehicle 100 is in a queue of vehicles, the energy management system 310 calculates 742 a recommended speed based on the queue information. The energy management system 310 next determines 750 whether accelerating or decelerating the vehicle 100 is more fuel efficient based on the queue information. If the energy management system 310 determined 750 that accelerating the vehicle is more fuel efficient based on the queue information, the energy management system 310 advises 726 the driver of a recommended speed or level of acceleration. If the energy management system 310 determined 750 that accelerating the vehicle is not more fuel efficient based on the queue information, the energy management system 310 advises 740 the driver to decelerate the vehicle 100.

Figure 8:
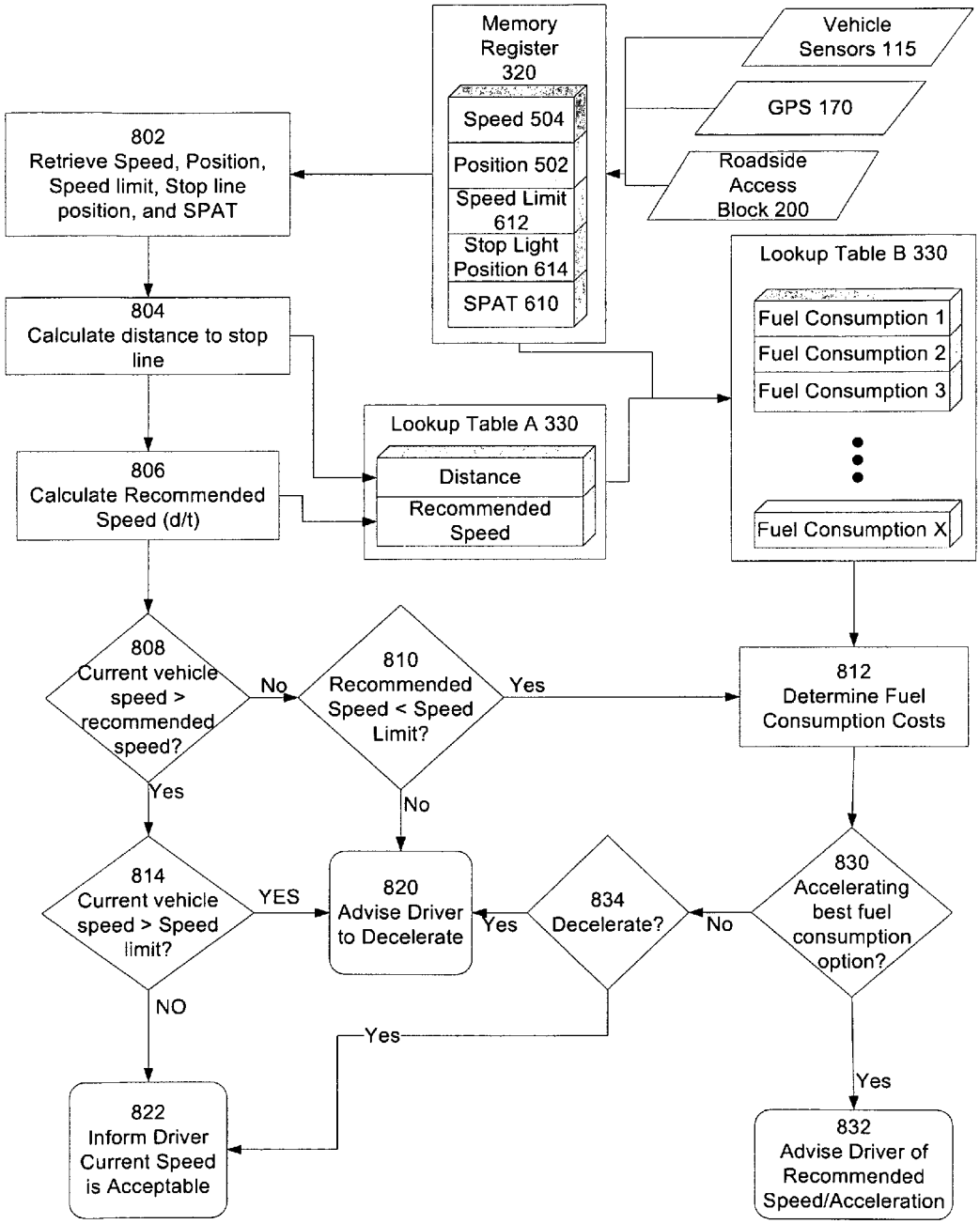
FIG. 8 is a flow chart illustrating steps performed by the energy management system to optimize the speed of the vehicle in accordance with an embodiment of the present invention.

FIG. 8 is a flow chart illustrating steps performed by the energy management system 310 to optimize the speed of the vehicle 100 according to one embodiment. The vehicle speed 504 is provided by the vehicle sensors 115 and stored in the memory register 320 by the on board data processing unit 180. Geographic co-ordinates specifying the vehicle position 502 are provided by the global positioning system 160 and stored in the memory register 320 by the on board data processing unit 180. The speed limit 312, geographic co-ordinates specifying the stop light position 614 and SPAT information 610 are provided by a roadside access unit 200 via I2V Message Set and stored in the memory register 320 by the energy management system 310. This data is processed as Messages Sets are received by the on board data processing unit 180 and stored in the register 320. The on board data processing unit 180 also updates the lookup table 330 as necessary. The energy management system 310 retrieves 802 the vehicle speed 504, geographic co-ordinates specifying the vehicle position 502, the speed limit 612, geographic co-ordinates specifying the stop light position 614 and SPAT information 610 from the memory register 320.

The energy management system 310 calculates 804 the distance between the vehicle 100 and the stop light (roadside access unit 200) based on the geographic co-ordinates specifying the vehicle's position 502 and the geographic co-ordinates specifying the stop light position 614 and stores the calculated distance in a lookup table A 330. The energy management system 310 calculates 806 a recommended speed for the vehicle 100 based on the distance between the vehicle 100 and the stop light and the SPAT information 310. This information is also stored in lookup table A 330. The energy management system 310 determines 808 whether the current vehicle speed 504 is greater than the recommended speed.

If the energy management system 310 determined 808 that the current vehicle speed 504 is greater than the recommended speed, the energy management system 310 determines 814 whether the current vehicle speed 504 is greater than the speed limit 612. If the energy management system 310 determined 814 that the current vehicle speed 504 is greater than the speed limit 612, the energy management system 310 produces a message to advise 820 the driver to decelerate and send it via the multimedia interface 120 or the driver signaling module 304. If the energy management system 310 determined 814 that the current vehicle speed 504 is not greater than the speed limit 612, the energy management system 310 produces a message to advise 822 the driver that the current vehicle speed 504 is acceptable and sends it via the multimedia interface 120 or the driver signaling module 304.

If the energy management system 310 determined 808 that the current vehicle speed 504 was not greater than the recommended speed, the energy management system 310 determines 810 whether the recommended speed is less than the speed limit 612. If the energy management system 310 determined 810 that the recommended speed is less than the speed limit 612, the energy management system 310 determines 812 the fuel consumption costs associated with accelerating to the stop light position and stopping the vehicle 100 at the stop light position based on the forward-looking or predictive model 340 which is derived from historic vehicle state information. The historic vehicle state information stores logs which indicate fuel consumption, velocity and acceleration rates for the vehicles. The energy management system 310 generates the forward-looking or predictive model 340 based on a generic equation to calculate efficiency and logged vehicle state information that is specific to the vehicle 100. In a specific embodiment, the energy management system 310 averages the logged historical vehicle state information in order generate values representing average fuel consumptions for different acceleration rates and velocities which are specific to the vehicle 100. In this embodiment, the predictive model 340 uses the average values for the different acceleration rates and velocities to identify a future fuel consumption rate based on the average values. In another embodiment, the fuel consumption cost associated with various action such as 1) accelerate to light, 2) decelerate to light, 3) stopping at light, etc. are calculated.

In this embodiment, only two possible options of decelerating to light in order to stop or accelerating to the light are determined 812. Once the fuel consumption costs have been determined 812, the method determines 830 whether accelerating is the best option to minimize fuel consumption. If the energy management system 310 determined 830 that accelerating is not the best option to minimize fuel consumption, the energy management system 310 determines 834 whether the driver needs to decelerate in order to stop at the stop light or to optimize fuel consumption. If the energy management system 310 determines 834 that the driver needs to decelerate in order to stop at the stop light or to optimize fuel consumption, the energy management system 310 provides 820 the driver with an advisement. If the energy management system 310 determines 834 that the driver does not need to decelerate in order to stop at the stop light, the energy management system 310 provides 822 the driver with an advisement that the current vehicle speed 504 is acceptable.

If the energy management system 310 determined 830 that accelerating the vehicle 100 provides the best fuel consumption cost, the energy management system 310 advises 832 the driver of the recommended speed and/or acceleration via the multimedia interface 120 or using the driver signaling module 304.

If in step 810 the energy management system 310 determined that the recommended speed is greater than the speed limit 612, the energy management system 310 advises 820 the driver to decelerate via the multimedia interface 120 or using the driver signaling module 304.

Figure 9:
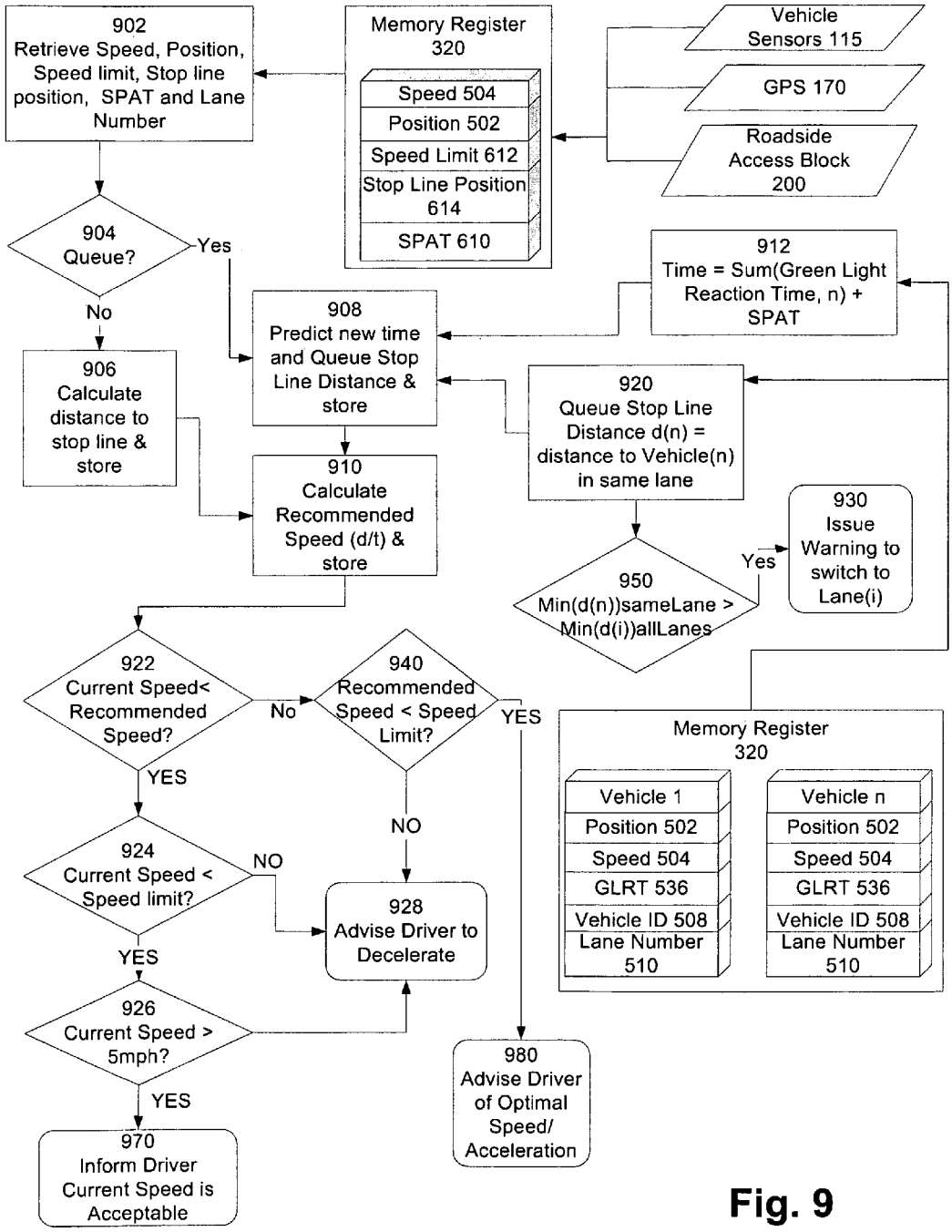
FIG. 9 is a flow chart illustrating steps performed by the energy management system to optimize the speed of the vehicle in accordance with an embodiment of the present invention.

FIG. 9 is a flow chart illustrating steps performed by the energy management system 310 to optimize the speed of the vehicle 100 according to one embodiment. The speed 504, position 502, speed limit 612, stop line position 614 and SPAT information 610 are received from the vehicle sensors 115, the global positioning system 160 and the roadside access unit 200, parsed and stored in the memory register 320 by the on board data processing unit 180. The on board data processing unit 180 also receives V2V Message Sets including neighbor vehicle state information from neighboring vehicles 102 and stores the neighbor vehicle state information in the memory register 320.

The energy management system 310 thereafter retrieves 902 vehicle state information including the speed 504, position 502, speed limit 612, stop line position 614 and SPAT information 610 from the memory register 320. The energy management system 310 determines 904 whether the vehicle 100 is in a queue of vehicles based on position 502 information associated with neighboring vehicles 102 stored in the memory register 320. If the energy management system 310 determined 904 that the vehicle 100 is in a queue of vehicles, the energy management system 310 predicts 908 a new queue wait time and a new queue stop line distance based on the neighbor vehicle state information stored in the memory register 320. More specifically, the energy management system 310 predicts 908 the new queue wait time and the new queue stop line based on existing or pre-calculated values of the queue wait time (see step 912 below) and the queue stop line distance (see step 920 below). In one embodiment, the energy management system 310 creates a forward looking or predictive model 340 based on information (e.g., queue wait time and queue stop line distance) in the memory register 320 as described below, and the forward looking or predictive model 340 is used to generate the control and advisory signals sent to the automated vehicle adjustment module 302 and the driver signaling module 304. The energy management system 310 also stores the new queue wait time and the new queue stop line distance in the lookup table 330.

As the V2V Message Sets are received, they are processed by energy management system 310 to calculate 912, 920 the queue wait time and the queue stop line distance d(n) q. This occurs some time prior to step 908 which uses this information. The energy management system 310 calculates 912 the queue wait time based on the sum of the predicted green light reaction times (GRLTs) 536 for each neighboring vehicle 102 in the queue and SPAT 610 information indicating an amount of time until the light turns green. The energy management system 310 generates the predicted GRLTs by modeling historic state information from each vehicle. In a specific embodiment, the energy management system 310 generates the predicted GRLTs by modeling other factors that affect the GRLTs such as visibility data, environmental data, time of day, etc. The energy management system 310 also calculates 920 the queue stop line distance d(n) based on the stop line position 614 and the combined length of each vehicle 100 in the queue of vehicles in the same lane. In some embodiments, the queue stop line distance further includes a specified distance representing a spacing buffer. In a specific embodiment, the energy management system 310 includes the spacing buffer only if the vehicle 100 is not stationary (i.e. the vehicle speed 504 is greater than zero). As an added safety measure, the energy management system 310 determines 950 whether the minimum queue stop line distance calculated for the lane in which the vehicle 100 is currently driving is greater than the minimum queue stop line distance calculated for proximate lanes. If the energy management system 310 determines 950 that the queue stop line distance calculated for the lane in which the vehicle 100 is currently driving Min(d(n)) is greater than the queue stop line distance calculated for a proximate lane Min(d(i)), the energy management system 310 issues 930 a recommendation to switch to the proximate lane i. If not, the method is complete and ends.

If in step 904 the energy management system 310 determined that the vehicle 100 is not in a queue of vehicles, the energy management system 310 calculates 906 the distance to the stop line based on the position 502 and the stop line position 614. This information is also stored 906 in the lookup table 330. Next, the energy management system 310 calculates 910 the recommended speed as the stop line distance divided by the time to signal change indicated by the SPAT information 610 or as the queue stop line distance divided by the queue wait time depending on whether step 910 reached through step 906 or 908.

Once the recommended speed has been calculated, the energy management system 310 determines 922 whether the current speed 504 is less than the determined recommended speed. If the energy management system 310 determined 922 that the current speed 504 is less than the recommended speed, the energy management system 310 determines 924 whether the current speed 504 is less than the speed limit 612. If the energy management system 310 determined 924 that the current speed 504 is less than the speed limit 612, the energy management system 310 determines 926 whether the current speed is greater than 5 miles per hour, or some other minimal preset speed. If the energy management system 310 determined 926 that the current speed 504 is greater than 5 miles per hour, the energy management system 310 advises 970 the driver that the current speed 504 is acceptable. If the energy management system 310 determined 924 that the current speed 504 is greater than the speed limit 612 or if the energy management system 310 determined 926 that the current speed 504 is greater than 5 miles per hour, the energy management system 310 advises 928 the driver to decelerate.

If the energy management system 310 determined 922 that the current speed 504 is not less than the recommended speed, the energy management system 310 determines 940 whether the recommended speed is less than the speed limit 612. If energy management system 310 determined 940 that the recommended speed is less than the speed limit, the energy management system 310 advises 980 the driver of the recommended speed. If the energy management system 310 determined 940 that the recommended speed is less than the speed limit 612, the energy management system 310 advises 928 the driver to decelerate.

Figure 10:
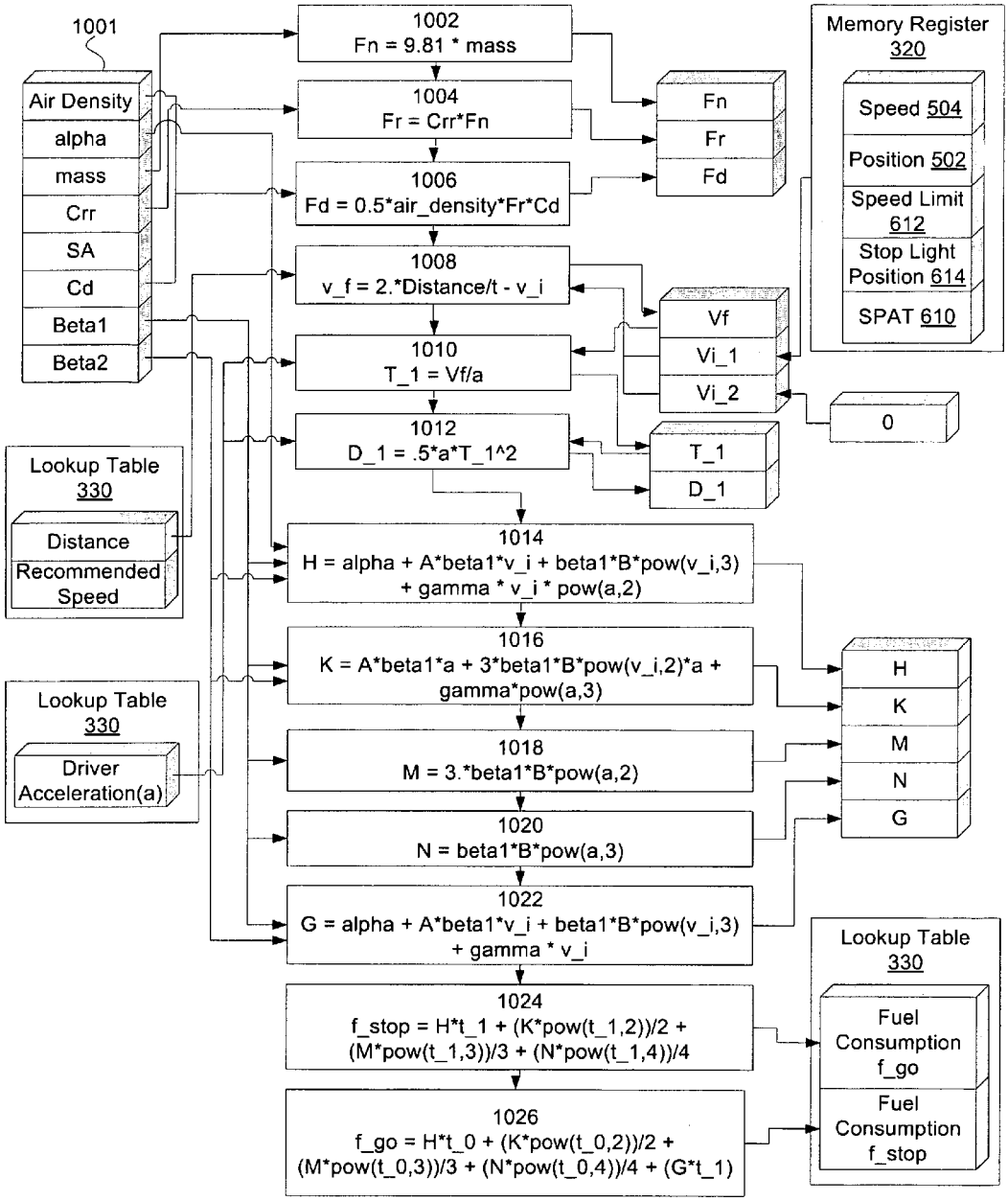
FIG. 10 is a flow chart illustrating steps performed by the energy management system to calculate fuel consumption information in accordance with an embodiment of the present invention.

FIG. 10 is a flow chart illustrating steps performed by the energy management system 310 to calculate fuel consumption information according to one embodiment. The energy management system 310 retrieves 1001 values including: air density, alpha, mass, coefficient of rolling resistance (Crr), surface area (SA), coefficient of drag (Cd), beta1 and beta2. The air density is the air density received from the environmental sensor 110. The mass is the mass of the vehicle 100. The coefficient of rolling resistance is a coefficient calculated based on the type of tires and the road surface information received in the I2V Environmental Message Set 606. The coefficient of drag is a constant coefficient which is the same for all vehicles 100. The alpha, beta1, beta2, gamma and B coefficients are weighting coefficients which vary according to the vehicle 100.

The energy management system 310 calculates 1002 the value Fn according to the formula Fn=mass*9.81. The energy management system 310 calculates 1004 the value Fr according to the formula Fr=Crr*Fn. The energy management system 310 calculates 1006 the value Fd according to the formula Fd=0.5*air density*Fr*Cd. The energy management system 310 calculates 1008 the value v_f according to the formula v_f=2.*Distance/t−v_i, where v_i represents the current velocity of the vehicle 100 and t represents the amount of time until the next signal phase change. The energy management system 310 calculates 1010 the value T_1 according to the formula T_1=Vf/a, where a represents an acceleration rate from lookup table 330. The energy management system 310 calculates 1012 the value D_1 according to the formula D_1=0.5*a*T_1^2. The energy management system 310 calculates 1014 the value H according to the formula H=alpha+(A*beta1*v_i+beta1*B*v_i$^3$)+(gamma*v_i*a$^2$). The energy management system 310 calculates 1016 the value K according to the formula K=A*beta1*a+(3*beta1*B*v_i$^2$)*a+(gamma*a$^3$). The energy management system 310 calculates 1018 the value M according to the formula M=3.*beta1*B*a$^2$. The energy management system 310 calculates 1020 the value N according to the formula N=beta1*B*a$^3$. The energy management system 310 calculates 1022 the value G according to the formula G=alpha+A*beta1*v_i+(beta1*B*v_i$^3$)+gamma*v_i. The energy management system 310 calculates 1024 the value f_stop representing the fuel consumption costs associated with stopping the vehicle according to the formula f_stop=H*t_1+(K*t_1$^2$)/2+(M*t_1$^3$)/3+(N*t_1$^4$)/4. The energy management system 310 calculates the value f_go representing the fuel consumption costs associated with accelerating the vehicle according to the formula f_go=H*t_0+(K*t_0$^2$)/2+(M*t_0$^3$)/3+(N*t_0$^4$)/4+(G*t_1). The energy management system 310 stores the values f_stop and f_go in the lookup table 330.

Figure 11:
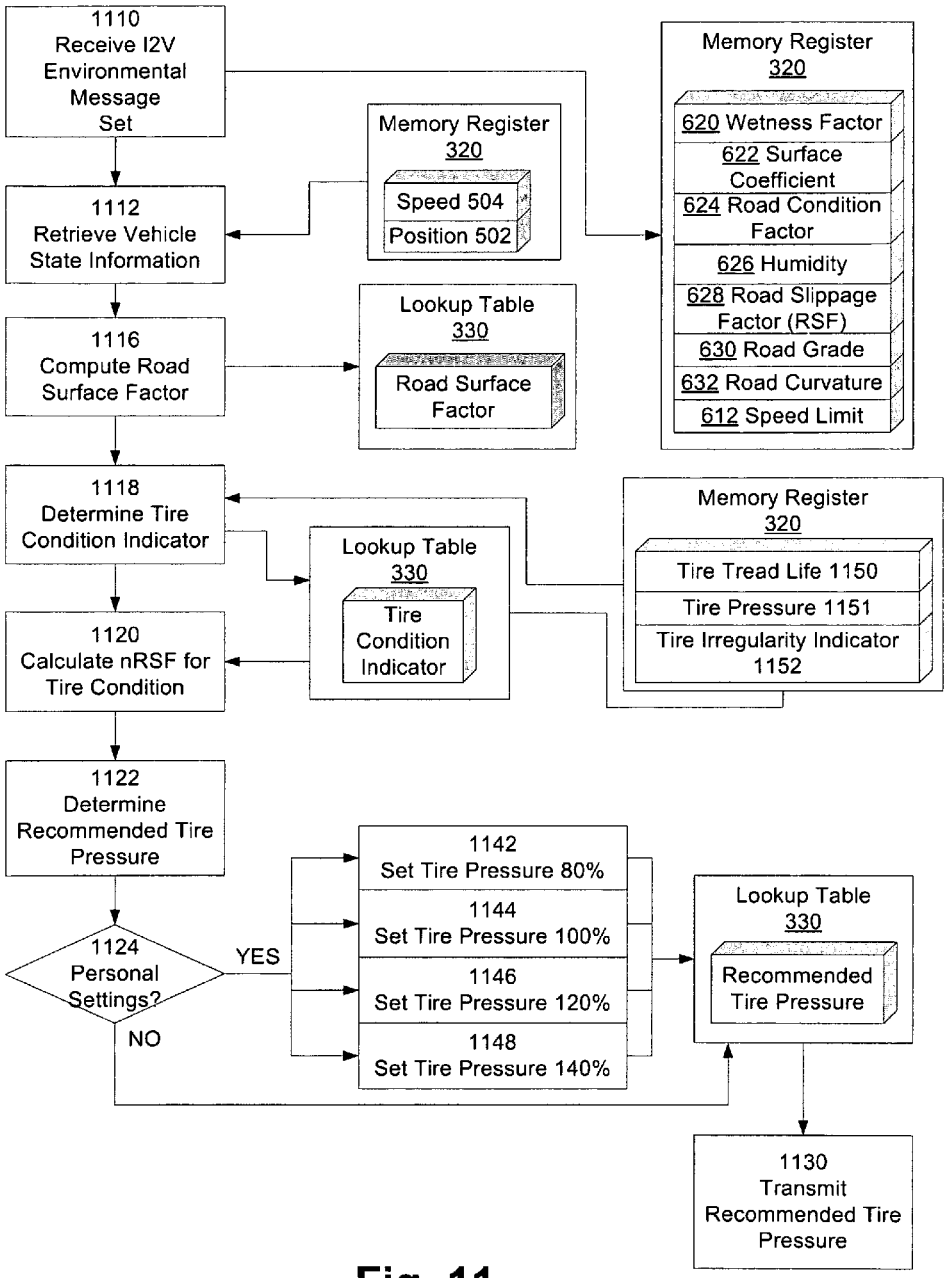
FIG. 11 is a flow chart illustrating steps performed by the energy management system to determine and set the tire pressure of the vehicle in accordance with an embodiment of the present invention.

FIG. 11 is a flow chart illustrating steps performed by the energy management system 310 to determine and set the tire pressure of the vehicle 100 according to one embodiment. The energy management system 310 receives 1110 an I2V Environmental Message Set 606 including environmental information and stores the environmental information in the memory register 320. The energy management system 310 retrieves 1112 vehicle state information for the vehicle 100 including the speed 504 and position 502 of the vehicle 100. The energy management system 310 computes 1116 a road surface factor based on the environmental information stored in the memory register 320. The energy management system 310 computes the road surface factors according to the formula: road surface factor=(alpha1*road wetness factor 620)+(alpha2*road surface coefficient 622)+(alpha3*road condition factor 624)+(alpha4*humidity 626)+(alpha5*road slippage factor 628)+(alpha6*road grade 630)+(alpha7*road curvature 632)+(alpha8*speed limit 612), where alpha1, alpha2, alpha3, alpha4, alpha5, alpha6, alpha7 and alpha8 are weighting coefficients which are standard across different vehicles. The energy management system 310 stores the road surface factor in a lookup table 330.

The energy management system 310 determines 1118 a tire condition indicator based on information received from the vehicle sensors 115 and stored in the memory register 320 including the tire tread life 1150, the tire pressure 1151 and the tire irregularity indicator 1152 and stores the tire condition indicator in a lookup table 330. In another embodiment, the tire condition indicator is also based on a model derived from the historic vehicle information such as the number of miles driven since the last tire change, information indicating handling of the vehicle 100 such as lateral acceleration of the vehicle 100, acceleration of the vehicle 100 and deceleration/braking of the vehicle 100. The energy management system 310 calculates 1120 a normalized road surface factor by normalizing the road surface factor based on the tire condition indicator. The energy management system 310 determines 1122 a recommended tire pressure based on the normalized road surface factor and stores the recommended tire pressure in the lookup table 330. The energy management system 310 determines whether 1124 there are personalization settings for tire pressure. If so, the based on the recommended tire pressure and the personalization settings, the automated vehicle adjustment module 302 sets 1142 the tire pressure to 80%, set 1144 the tire pressure to 100%, set 1146 the tire pressure to 120% or set 1148 the tire pressure to 140%; and store this value in the lookup table 330. If not, the recommended tire pressure from step 1122 is stored in the lookup table 330. The energy management system 310 then transmits 1130 the recommended tire pressure to the automated vehicle adjustment module 302 to adjust the tire pressure. Based on the recommended tire pressure and the personalization settings, the automated vehicle adjustment module 302 sets the tire pressure to the recommended value. In an alternate embodiment, rather than automatically adjusting the tire pressure, an advisory is sent instead using the driver signaling module 304.

Figure 12:
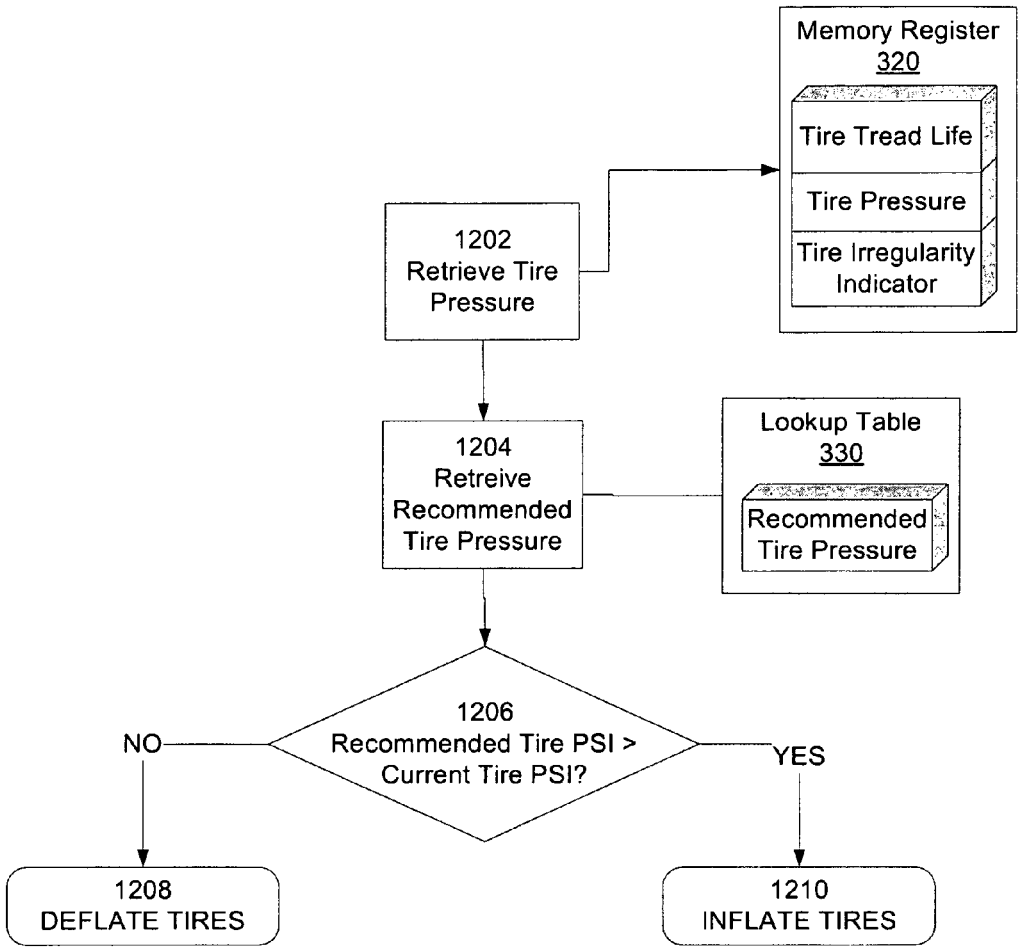
FIG. 12 is a flow chart illustrating steps performed by the energy management system to adjust the tire pressure of the vehicle in accordance with an embodiment of the present invention.

FIG. 12 is a flow chart illustrating steps performed by the energy management system 310 to adjust the tire pressure of the vehicle 100 according to one embodiment. The energy management system 310 retrieves 1202 the current tire pressure from the memory register 320. The energy management system 310 retrieves 1204 the recommended tire pressure from the lookup table 330. The energy management system 310 determines 1206 whether the recommended tire pressure is greater than the current tire pressure. If the energy management system 310 determines 1206 that the recommended tire pressure is greater than the current tire pressure, the energy management system 310 issues a signal on bus 130 to inflate 1210 the tires. If the energy management system 310 determines 1206 that the recommended tire pressure is less than the current tire pressure, the energy management system 310 issues a signal on bus 130 to deflate 1208 the tires.

Figure 13:
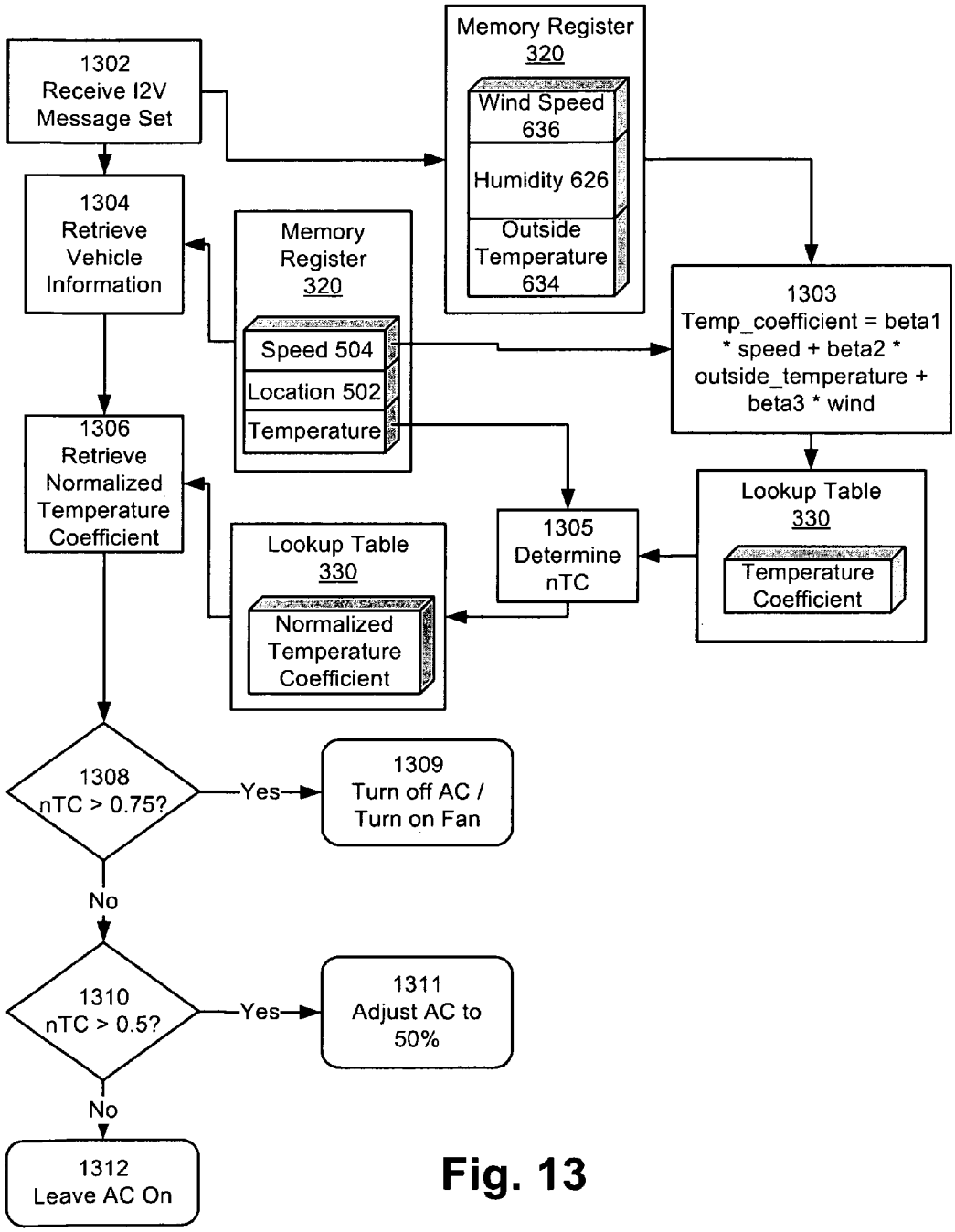
FIG. 13 is a flow chart illustrating steps performed by the energy management system to adjust the vehicle temperature in accordance with an embodiment of the present invention.

FIG. 13 is a flow chart illustrating steps performed by the energy management system 310 to adjust the vehicle temperature according to one embodiment. The energy management system 310 receives 1302 an I2V Environmental Message Set 606 from a roadside access unit 200 specifying environmental information including wind speed 636, outside temperature 634 and humidity 626 and stores the environmental information in the memory register 320. The energy management system 310 retrieves 1304 the current vehicle state information including speed 504, position 502 and temperature 507 from the memory register 320. The energy management system 310 determines 1303 the temperature coefficient, based on the following formula: (beta1*speed 504)+(beta2*outside temperature 634)+(beta3*wind speed 636), where beta1, beta2 and beta 3 are weighting coefficients. The energy management system 310 stores the temperature coefficient in the lookup table 330.

The energy management system 310 then determines 1305 the normalized temperature coefficient based on vehicle state information such as temperature 507 and speed 504. The temperature coefficient is normalized to a scale between 0 and 1, with a value closer to 1 indicating that the temperature is optimum for fuel efficiency and passenger comfort and a value closer to 0 indicating that the temperature is above that for optimum for fuel efficiency and passenger comfort. The normalized temperature coefficient is stored in the lookup table 330. Sometime thereafter, the normalized temperature coefficient is retrieved 1306 from the lookup table 330 by the 330 The energy management system 310. The energy management system 310 determines 1308 whether the normalized temperature coefficient is greater than a threshold value. If the energy management system 310 determined 1308 that the normalized temperature coefficient is greater than a first threshold value (e.g. 0.75), the energy management system 310 communicates over the bus 130 to turn off 1309 the vehicle air conditioning and/or fan associated with the vehicle 100. If the energy management system 310 determines 1308 that the normalized temperature coefficient is not greater than the first threshold value, the energy management system 310 performs a second test to determine 1310 whether the normalized temperature coefficient is greater than a second threshold value (e.g. 0.5). If the energy management system 310 determines 1310 that the normalized temperature coefficient is greater than the second threshold value, the energy management system 310 adjusts 1311 the air conditioning to a reduced percentage of time and/or magnitude (e.g. 50% of the regular air conditioning cycle). If the energy management system 310 determines 1310 that the normalized temperature coefficient is not greater than the second threshold value, the energy management system 310 leaves 1312 the air conditioning on. In an alternate embodiment, the energy management system 310 adjusts 1311 the air conditioning to operate a greater percentage of the time or at a higher magnitude.

Figure 14:
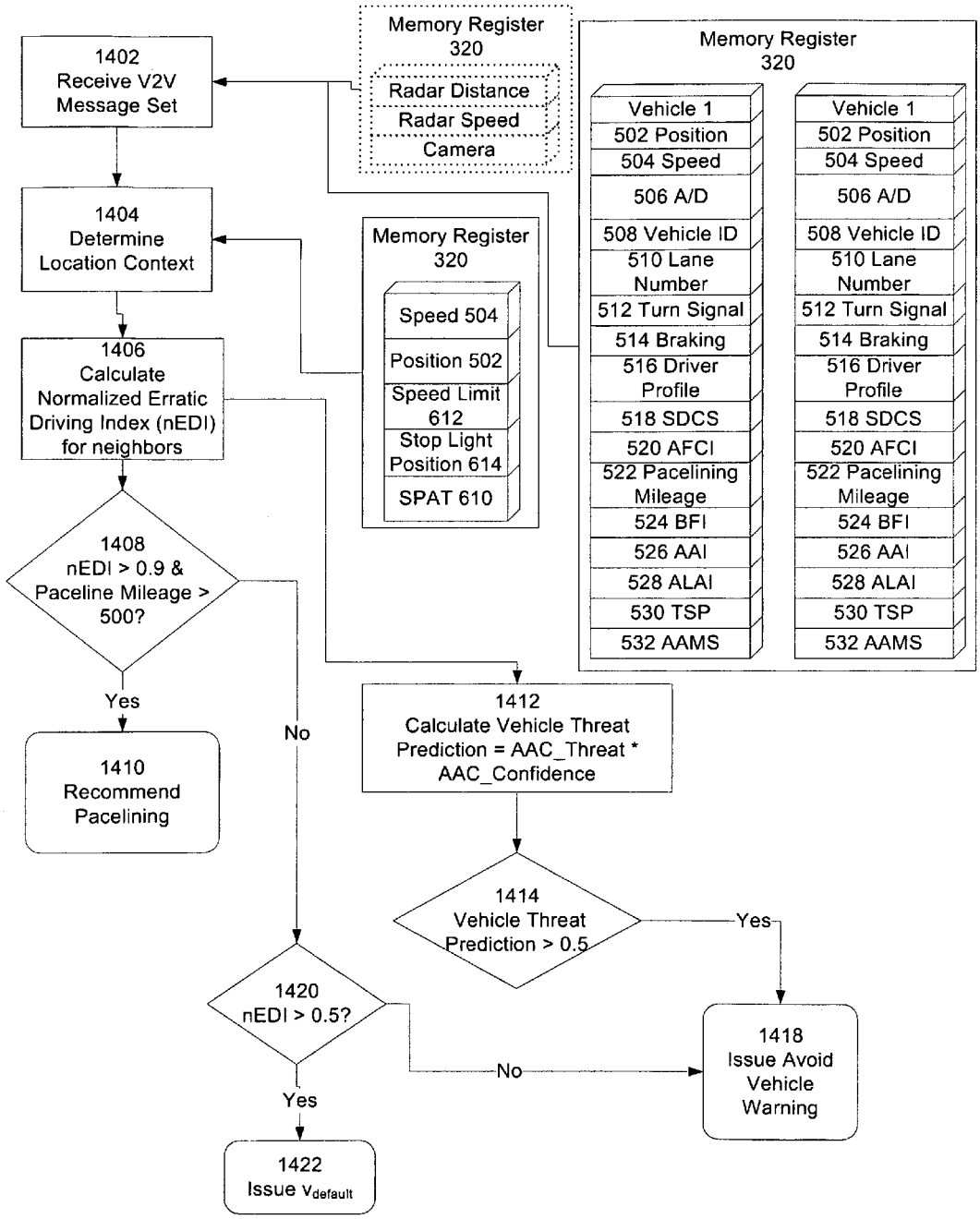
FIG. 14 is a flow chart illustrating steps performed by the energy management system to analyze vehicle state information from neighboring vehicles in accordance with an embodiment of the present invention.

FIG. 14 is a flow chart illustrating steps performed by the energy management system 310 to analyze vehicle state information from neighboring vehicles 102 according to one embodiment. The energy management system 310 receives 1402 one or more V2V Vehicle State Message Sets 520 including vehicle state information from one or more neighboring vehicles 102. In alternate embodiments, the energy management system 310 also receives 1402 information about the driving behavior of neighboring vehicles such as radar distance 1451, radar speed 1452 and camera 1453 in I2V Message Sets received from roadside access units 200.

The energy management system 310 determines 1404 a location context for the vehicle 100 and the neighboring vehicles 102 based on vehicle state information stored in the memory register 320 such as speed 504 and position 502 and intersection information stored in the memory received in an I2V Intersection Message Set 602 and stored in the memory register 320.

The energy management system 310 calculates 1406 a normalized erratic driving index (nEDI) for each of the neighboring vehicles 102. Calculation 1406 of the nEDI is discussed in detail below with reference to FIG. 16. The energy management system 310 determines 1408 whether the nEDI is greater than a threshold value (e.g. 0.9) and the pacelining mileage is greater than a threshold value (e.g. 500 miles). If the energy management system 310 determines 1408 that the nEDI is above a threshold value and the pacelining mileage is above the threshold value, the energy management system 310 recommends 1410 pacelining to the driver of the vehicle 100 with the neighboring vehicle 102.

If the energy management system 310 determines 1408 that either the nEDI is not above a threshold value or the pacelining mileage is not greater than a threshold value, the energy management system 310 determines 1420 whether the nEDI is above a second nEDI threshold value (e.g. 0.5). If the energy management system 310 determined 1420 that the nEDI is above the second threshold value, the energy management system 310 issues the default speed and behavior advisory for the vehicle 100. If the energy management system 310 determines 1420 that the nEDI is below the second nEDI threshold value, the energy management system 310 issues 1418 a warning to the driver to avoid the neighboring vehicle 102.

The energy management system 310 further calculates 1412 a vehicle threat prediction value for each neighboring vehicle 102 based on the product of the Associated Action Code (AAC) Threat value and the AAC Confidence value. The energy management system 310 stores a history of AACs threat and confidence values in association with timestamps specifying a time of day at which the action was performed and co-ordinates specifying the position 502 of the car as tabulated in the example below.

| UTC TIME | Latitude | Longitude | Associated Action Code |
|---|---|---|---|
| Time 1 | x1 | y1 | A |
| Time 2 | x2 | y2 | B |
| Time 3 | x3 | y3 | C |
| Time 4 | x4 | y4 | D |
| Time n | xn | yn | E |

Based on the current time and position 502 of the car, the energy management system 310 calculates a sets of predicted Associated Action Codes or relative weightings that indicate which action the vehicle 100 has the highest probability of performing based on its history of Associated Action Codes and a confidence value which indicates the statistical confidence associated with the likelihood that the vehicle will perform the AAC.

| UTC TIME | Latitude | Longitude | Predicted AAC Threat | Confidence |
|---|---|---|---|---|
| Time t | px1 | py1 | Heavy braking | w |
| Time t + 1 | px2 | py2 | Frequent lane change | x |
| Time t + 2 | px3 | py3 | No signal when turning | y |

-continued

| UTC TIME | Latitude | Longitude | Predicted AAC Threat | Confidence |
|---|---|---|---|---|
| Time t + 3 | px4 | py4 | Swerving | z |
| Time t + n | pxn | pyn | Lateral Acceleration | v |

Vehicle likelihood of performing an action can be determined by building a probabilistic model based on the history of associated action codes. Suitable probabilistic models include sequential models such as Markov models and classification models.

The AAC Confidence Value specifies a confidence in the likelihood that the vehicle will perform the action. Typically, the AAC Confidence Value is proportional to the frequency of the association between the time and/or position 502 of the vehicle and the action. For instance, a vehicle 100 that frequently brakes at a given time or position 502 will have a higher AAC Confidence Value than a vehicle 100 that brakes at the given time and/or position less frequently. The AAC Threat Value specifies whether the vehicle's 100 next predicted Associated Action Code indicates an Action which will cause a threat to the vehicle 100 or another vehicle 100.

The energy management system 310 determines 1414 whether the vehicle threat prediction value is greater than a predetermined values such as 0.5. If the energy management system 310 determines 1414 that the vehicle threat prediction value is greater than 0.5, the energy management system 310 issues 1418 a warning to the driver to avoid the neighboring vehicle 102.

Figure 15:
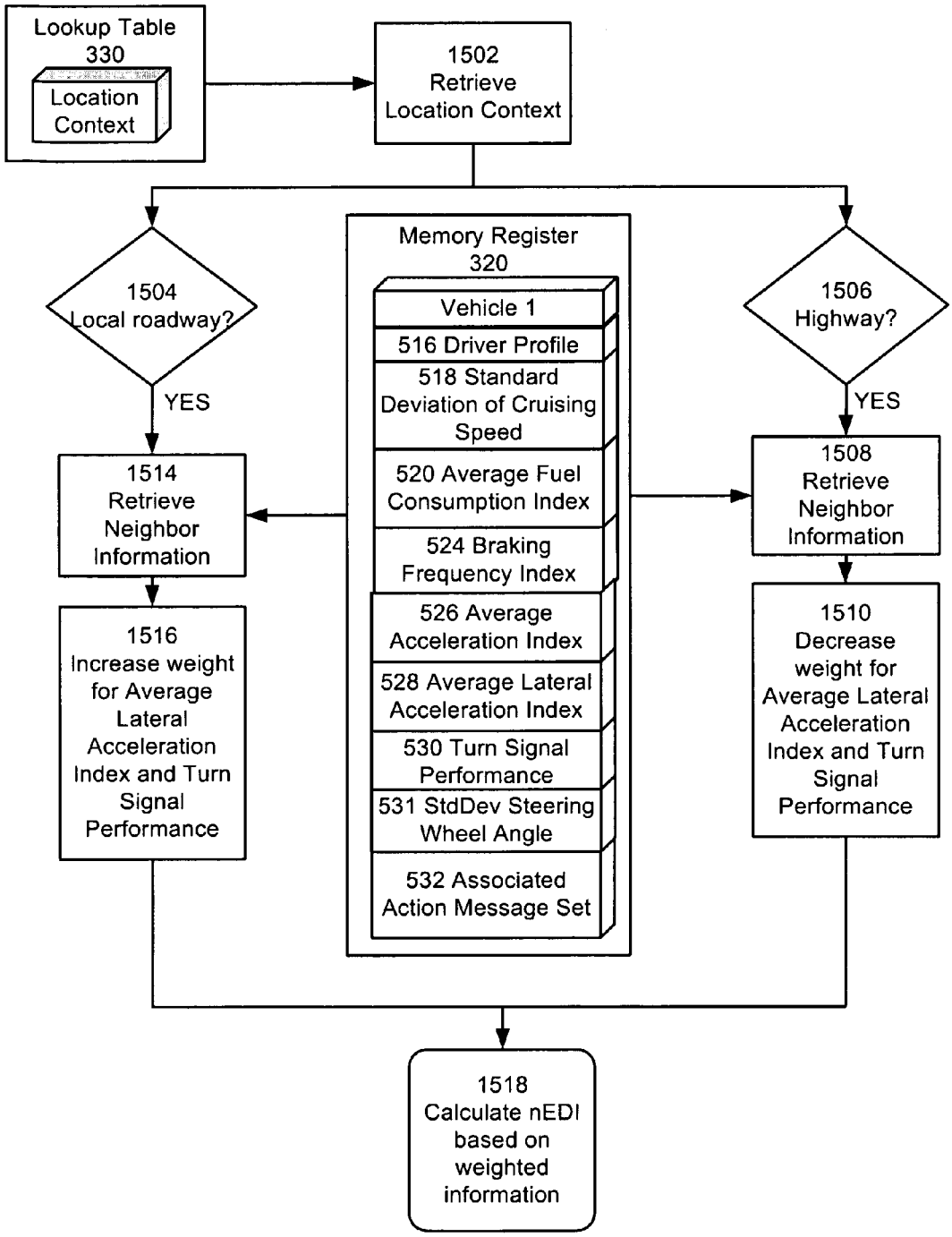
FIG. 15 is a flow chart illustrating steps performed by the energy management system to calculate an erratic driving index in accordance with an embodiment of the present invention.

FIG. 15 is a flow chart illustrating steps performed by the energy management system 310 to calculate a normalized erratic driving index according to one embodiment. The energy management system 310 retrieves 1502 the calculated location context from the lookup table 330. The method then continues to determine 1504 whether the retrieved location content specifies a local roadway and to determine 1506 whether the retrieved location content specifies a highway. If the energy management system 310 determined 1504 that the retrieved location content specifies that the location is a local roadway, the energy management system 310 retrieves 1514 the neighbor vehicle state information stored in the memory register 320, for example, the neighbor vehicle state information including the driver profile 516, the standard deviation of the cruising speed 518, the average fuel consumption index 520, the braking frequency index 524, the average acceleration index 526, the average lateral acceleration index 528, the turn signal performance 530, the standard deviation of the steering wheel angle 531 and the associated action message set 532. The energy management system 310 increases 1516 the weights associated with the average lateral acceleration index 528 and the turn signal performance 530. If in step 1504, the retrieved location content does not specify a local roadway, this branch of the process is complete and ends.

If the energy management system 310 determined 1506 that the retrieved location content specifies that the location is a local roadway, the energy management system 310 retrieves 1508 the neighbor vehicle state information stored in the memory register 320. The neighbor vehicle state information includes the driver profile 516, the standard deviation of the cruising speed 518, the average fuel consumption index 520, the braking frequency index 524, the average acceleration index 526, the average lateral acceleration index 528, the turn signal performance 530, the standard deviation of the steering wheel angle 531 and the associated action message set 532. The energy management system 310 decreases 1510 the weights associated with the average lateral acceleration index 528 and the turn signal performance 530. If in step 1504, the retrieved location content does not specify a highway, this branch of the process is complete and ends.

After either step 1510 or 1516, the energy management system 310 calculates 1518 the normalized erratic driving index for the neighboring vehicle(s) based on the weighted neighbor vehicle state information.

Figure 16:
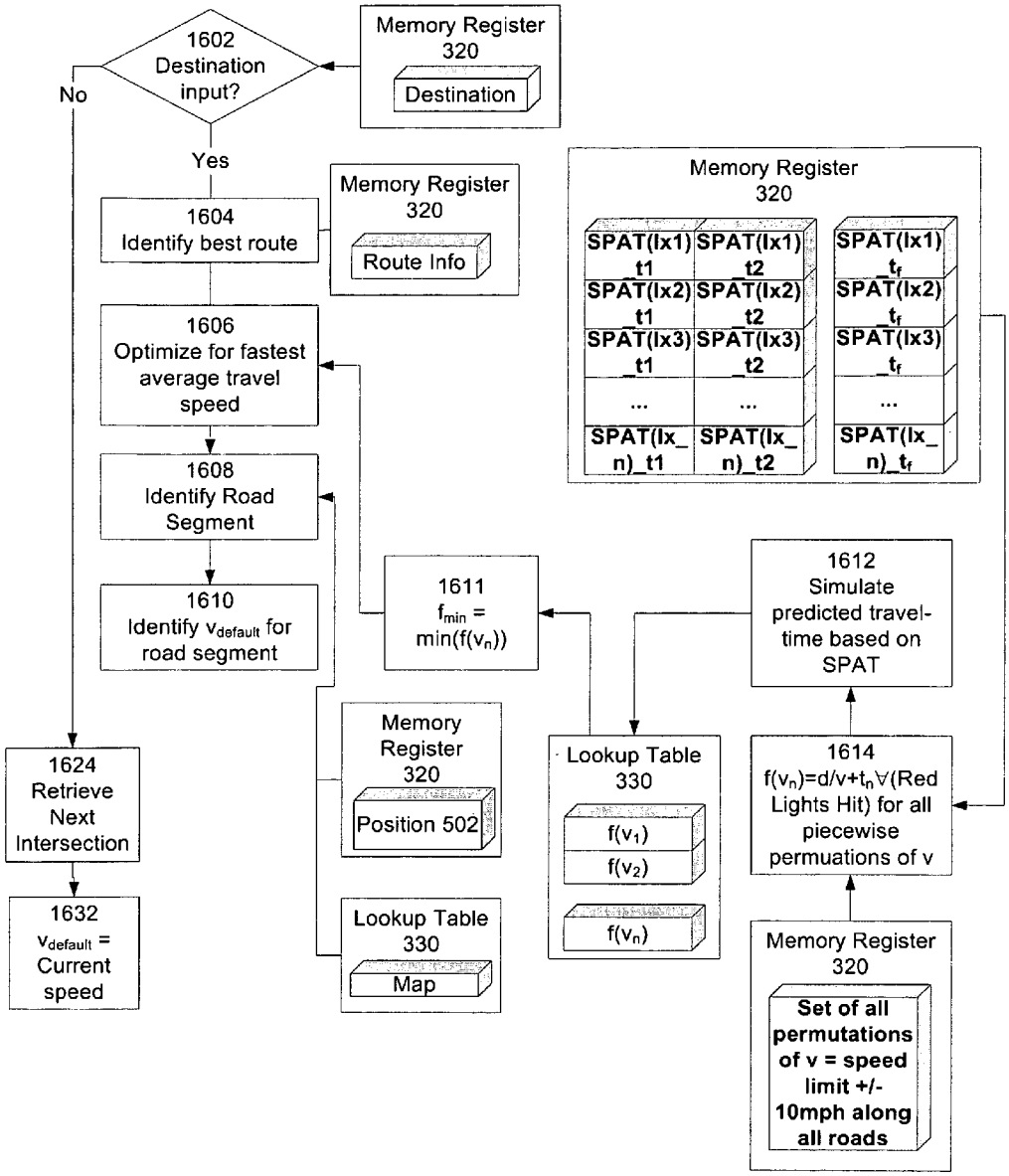
FIG. 16 is a flow chart illustrating steps performed by the energy management system to optimize vehicle speed based on destination information in accordance with an embodiment of the present invention.

FIG. 16 is a flow chart illustrating steps performed by the energy management system 310 to optimize vehicle speed 504 based on destination information according to one embodiment. The energy management system 310 determines 1602 whether destination information has been input or receive. If such information was input, it would have been stored in the memory register 320, so the memory register 320 is accessed and any destination information, if present, is retrieved. If the energy management system 310 retrieves 1602 a destination, the energy management system 310 identifies 1604 the best route to the destination. The best route can be determined based on user preferences, time of day, shortest time, shortest path, paths with no highways or other conventional route calculation techniques. In one embodiment, the energy management system 310 communicates with the GPS 160 to identify the best route or may determine the best route using alternate means.

The energy management system 310 optimizes 1606 the best route for fastest average travel speed. In order to optimize the best route, the energy management system 310 first simulate 1612 the predicted travel-time based on SPAT information 610 associated with the route stored in the memory register 320. The simulation is based on travel times $f(v_1) \ldots f(v_n)$ based on the distance to the destination divided by the speed v plus the time associated with the predicted number of red lights hits at the speed v, where $v_1$ through $v_n$ represent the piecewise permutations of v. The piecewise permutations of v are the different velocities associated with the road segments that the route comprises. Different permutations of v are selected to optimize the speed v and the number of red lights hit. The energy management system 310 the permutations of v based on the speed limit 612 associated with the road segment plus or minus 10 miles per hour. The energy management system 310 then calculates 1614 the travel times. These travel times are used by the energy management system 310 to simulate 1612 predicted travel times before the predicted travel times are stored in the lookup table 330. The energy management system 310 selects 1611 the minimum travel time as the minimum of the travel times stored in the lookup table 330 (i.e. $\min(f(v_1) \ldots f(v_a))$). This minimum travel time is provided and used in the optimization step 1606.

The energy management system 310 identifies 1608 the road segments associated the route. The energy management system 310 identifies 1610 the default speed for the road segment based on the speed v specified in the optimized travel time.

If the energy management system 310 determined 1602 that a destination was not input, the method continues in step 1624 using a possible destination. The possible destination may determined using location and direction information from the global positioning system 160 or may be determined by the energy management system 310 by analyzing historic vehicle state information. A model of the driver's preference destination or route are derived from the historic vehicle state information for the vehicle 100 such that a route/destination is associated with a specific probability based on the time of day (e.g. a 90% chance of route1/destinationA at 5:00 PM). Using the possible destination, the energy management system 310 retrieves 1624 SPAT information 610 for the next intersection controlled by a traffic signal and determines 1632 a default speed/behavior based on the current speed 504.

Figure 17:
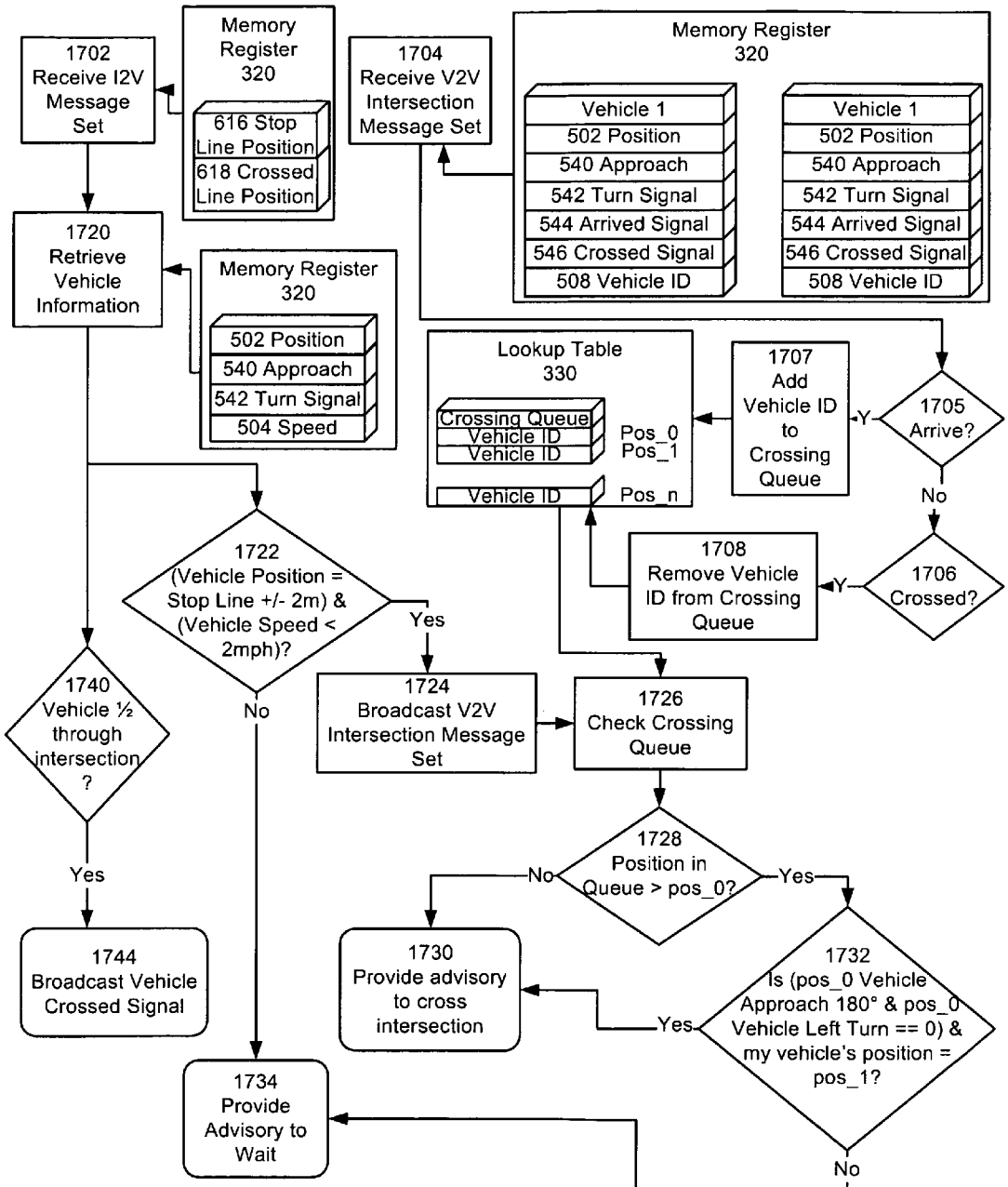
FIG. 17 illustrates steps performed by the energy management system to arbitrate an intersection controlled by a stop sign in accordance with an embodiment of the present invention.

FIG. 17 illustrates an example of steps performed by the energy management system 310 to arbitrate an intersection controlled by a stop sign according to one embodiment. The energy management system 310 receives 1702 an I2V Stop Sign Message Set 604 specifying stop sign information and stores the stop sign information in the memory register 320. The energy management system 310 also receives 1704 one or more V2V Intersection Message Sets 530 specifying neighbor vehicle intersection information and stores the neighbor vehicle state information in the memory register 320.

Based on the V2V Intersection Message Sets 530, the energy management system 310 determines 1705 whether the neighboring vehicles have arrived at an intersection. If the energy management system 310 determined 1705 that the neighboring vehicles have arrived at an intersection based on the arrived signal 544 data, the energy management system 310 adds 1707 the vehicle IDs 508 for the neighboring vehicles 102 to the crossing queue stored in the lookup table 330. If the energy management system 310 determined 1705 that the neighboring vehicles have not arrived at an intersection based on the arrived signal 544 data, the energy management system 310 determines 1706 whether the neighboring vehicles have crossed the intersection based on the crossed signal 546 data. If the energy management system 310 determined 1706 that the neighboring vehicles crossed the intersection, the energy management system 310 removes 1708 the vehicle IDs 508 from the lookup table 330. If the energy management system 310 determines 1706 that the neighboring vehicles have not crossed, this branch of the process is complete and ends.

Based on the I2V Intersection Message Sets 602, the energy management system 310 retrieves 1720 intersection information associated with the vehicle 100 including the position 502, approach 540, turn signal 542 and speed 504 associated with the vehicle 100. The energy management system 310 then makes two determinations in step 1740 and step 1722.

In step 1740, the energy management system 310 determines whether the vehicle 100 is more than halfway through the intersection. If energy management system 310 determines 1740 that the vehicle 100 is more than halfway through the intersection, the energy management system 310 transmits a V2V Intersection Message Set 530 including a vehicle crossed signal to the neighboring vehicles 102. If the vehicle is not more than halfway through the intersection, no further action is required in this branch of the method is complete.

In step 1722, the energy management system 310 determines whether the position 502 of the vehicle 100 is within 2 meters of the stop line position 616 and the speed 504 of the vehicle is less than 2 miles per hour. If the energy management system 310 determined 1722 that either the position 502 of the vehicle 100 is not within 2 meters of the stop line position 616 or the speed 504 of the vehicle is not less than 2 miles per hour, the energy management system 310 provides 1734 the driver of the vehicle 100 with an advisory to wait at the intersection.

If the energy management system 310 determined 1722 that the position 502 of the vehicle 100 is within 2 meters of the stop line position 616 and the speed 504 of the vehicle is less than 2 miles per hour, the energy management system 310 transmits 1724 a V2V Intersection Message Set 530 to the neighboring vehicles 102. The energy management system 310 retrieves 1726 the cross queue information and determines 1728 whether the vehicle 100 is in the first position in the crossing queue. If the energy management system 310 determines 1728 that the vehicle 100 is in the first position in the crossing queue, the energy management system 310 provides 1730 the driver of the vehicle 100 with an advisory to cross the intersection. In some embodiments, the energy management system 310 determines (not shown) an overall threat level prior to providing 1730 the driver of the vehicle with an advisory to cross the intersection. In these embodiments, the energy management system 310 determines the AAC threat level based on the predicted AACs received in V2V Intersection Message Sets 530 from the neighboring vehicles. If the threat level exceeds a threshold value, the driver of the vehicle 100 may be advised to remain at the intersection until the one or more vehicle associated with AAC threat level which cause the overall threat level to exceed some value have crossed the intersection.

If the energy management system 310 determines 1728 that the vehicle 100 is not in the first position in the crossing queue, the energy management system 310 determines 1732 whether the vehicle 100 is in the second position in the crossing queue and the neighboring vehicle 102 that is in the first position in the crossing queue is making a right turn based on the approach 540 and turn signal 542 information associated with the neighboring vehicle 102. If the energy management system 310 determines 1732 that vehicle 100 is in the first position in the crossing queue and the neighboring vehicle 102 that is in the first position is making a right turn, the energy management system 310 provides 1730 the driver of the vehicle 100 with an advisory to cross the intersection. If the energy management system 310 determines that that is in the first position is not making a right turn, the energy management system 310 provides 1734 the driver of the vehicle 100 with an advisory to wait at the intersection.

Figure 18:
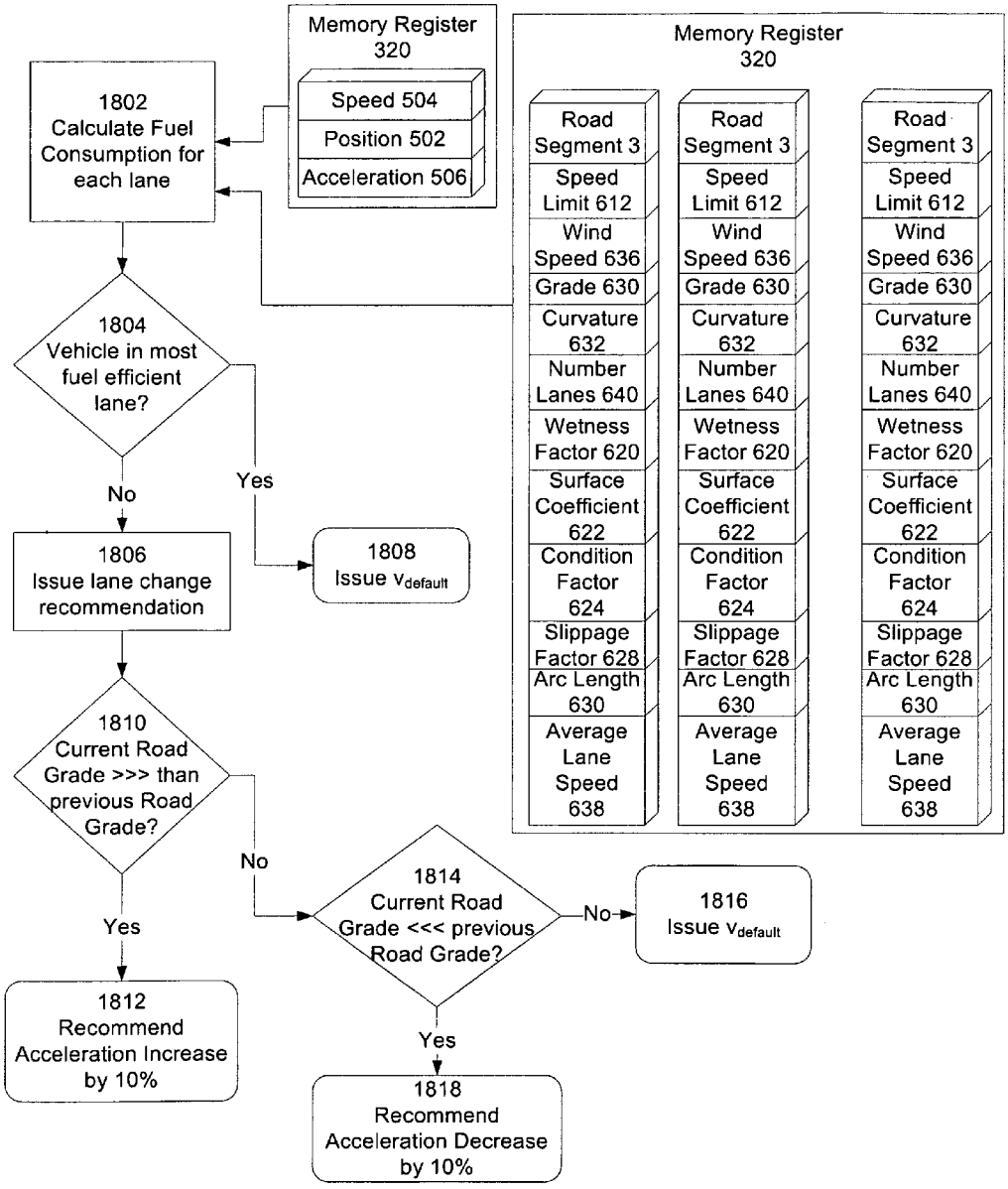
FIG. 18 is a flow chart illustrating steps performed by the energy management system to optimize vehicle acceleration in accordance with an embodiment of the present invention.

FIG. 18 is a flow chart illustrating steps performed by the energy management system 310 to optimize lane selection and acceleration for energy efficiency according to one embodiment. The energy management system 310 calculates 1802 the fuel consumption for a plurality of lanes in a road based on information received in an I2V Environmental Message Set 606 and stored in the memory register 320. The energy management system 310 calculates 1802 the fuel consumption based on the speed limit 612, the wind speed 636, the road grade 630, the road curvature 632, the wetness factor 620, the road surface coefficient 622, the road condition factor 624, the road slippage factor 628, the arc length 630 and the average lane speed of the road 538.

The energy management system 310 determines 1804 whether the vehicle 100 is in the most fuel efficient lane based on the fuel consumption calculated for each lane. If the energy management system 310 determines 1804 that the vehicle 100 is in the most fuel efficient lane, the energy management system 310 issues 1808 the default speed 504 and/or behavior for the vehicle 100 (e.g., maintain status quo). If the energy management system 310 determines 1804 that the vehicle 100 is not in the most fuel efficient lane, the energy management system 310 provides 1806 the driver of the vehicle 100 with a recommendation to change lanes. If the driver changes lanes, the energy management system 310 determines 1810 whether the road grade 630 for the current lane is much greater than the road grade for the previous lane. If so, the energy management system 310 provides 1812 the driver of the vehicle 100 with a recommendation to increase the acceleration 506 of the vehicle by 10%.

If the energy management system 310 determined 1810 that the road grade 630 associated with the current lane is not greater than the road grade associated with the previous lane, the energy management system 310 determines 1814 whether the road grade 630 associated with the current lane is less than the road grade 630 associated with the previous lane. If the energy management system 310 determined 1814 that the road grade 630 associated with the current lane is less than the road grade 630 associated with the previous lane, the energy management system 310 provides 1818 the driver of the vehicle with a recommendation to decrease the acceleration 506 of the vehicle by 10%. If the energy management system 310 determines 1814 that the road grade 630 associated with the current lane is not less than the road grade 630 associated with the previous lane, the energy management system 310 issues a recommendation 1808 to use the default speed 504 and/or behavior for the vehicle 100.

Figure 19:
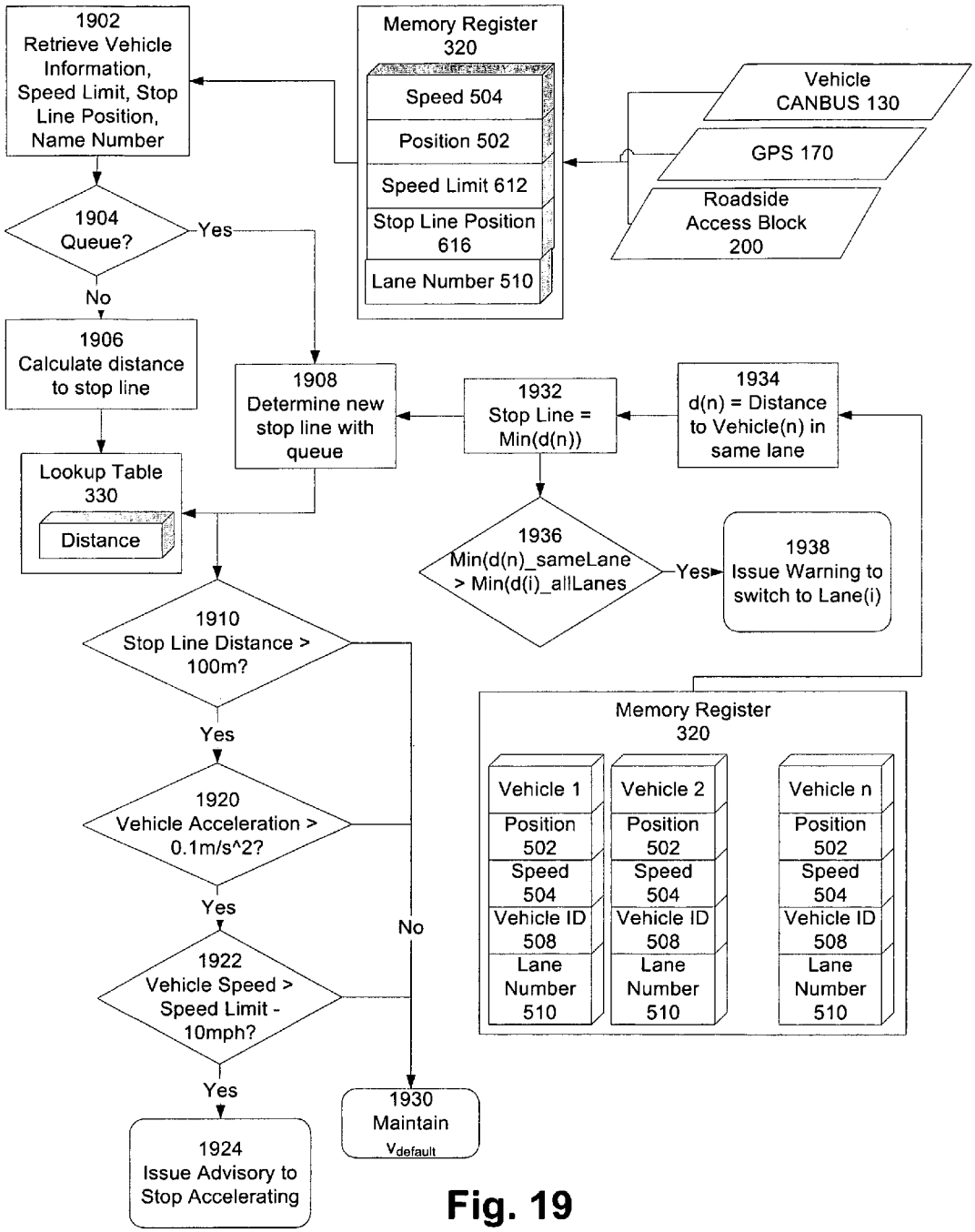
FIG. 19 is a flow chart illustrating steps performed by the energy management system to optimize vehicle speed in accordance with an embodiment of the present invention.

FIG. 19 is a flow chart illustrating steps performed by the energy management system 310 to optimize vehicle speed 504 for energy efficiency according to one embodiment. The energy management system 100 retrieves 1902 vehicle information, stop line position, speed limit and lane number received from the vehicle sensors 115, the GPS System 180 and the roadside access unit 200 and stored in the memory register 320.

The energy management system 310 determines 1904 whether the vehicle 100 is in a queue of vehicles based on neighbor vehicle information received in V2V intersection Message Sets 606 and stored in the memory register 320. If the energy management system 310 determined 1904 that the vehicle 100 is not in a queue of vehicles, the energy management system 310 calculates 1906 a queue stop line distance and stores it in the lookup table 330. If the energy management system 310 determined 1904 that the vehicle 100 is in a queue of vehicles, the energy management system 310 determines 1908 a new stop line distance between the position 504 of the vehicle 100 and the stop line position 616 due to the queue of other vehicles 102. The new stop line distance due to a queue of vehicles is determined 1908 based on the distance to other vehicles as determined in step 1936 and the minimum stop line distance as determined in step 1932. The process also compares 1936 the minimum stop line distance to determine if it is greater than the distance in other lanes, and if so energy management system 310 issues 1938 a warning to switch lanes.

The energy management system 310 determines 1910 whether the distance between the vehicle 100 and the stop line or queue stop line is greater than 100 meters. If the energy management system 310 determines 1910 that the distance is greater than 100 meters, the energy management system 310 determines 1920 whether the acceleration 506 of the vehicle 100 is greater than 0.1 $m/s^2$. If the energy management system 310 determines 1920 that the acceleration 506 of the vehicle 100 is greater than 0.1 $m/s^2$, the energy management system 310 determines 1922 whether the speed 504 of the vehicle 100 is greater than 10 miles per hour less than the speed limit 614. If the energy management system 310 determines 1922 that the speed 504 of the vehicle 100 is greater than 10 miles per hour less than the speed limit 614, the energy management system 310 provides 1924 an advisory to the driver to stop accelerating.

If the energy management system 310 determined 1910 that the distance is greater than 100 meters or if the energy management system 310 determined 1920 that the acceleration 506 of the vehicle 100 is greater than 0.1 $m/s^2$ or if the energy management system 310 determined 192 that the speed 504 of the vehicle 100 is not less than 10 miles per hour less than the speed limit 614, the energy management system 310 provides an indication to maintain 1930 the default speed 504 and/or behavior for the vehicle 100.

While the invention has been described with respect to a limited number of embodiments, those skilled in the art, having benefit of the above description, will appreciate that other embodiments may be devised which do not depart from the scope of the present invention as described herein. Accordingly, the scope of the present invention should be limited only by the appended claims.

The invention claimed is:

1. A computer-implemented method of controlling operation of one or more subsystems of a plurality of subsystems of a vehicle to improve performance, the method comprising:

storing at a vehicle, historic vehicle state information specifying a plurality of performance values associated with a plurality of subsystems of the vehicle at a plurality of time points, including a current time point;

receiving at the vehicle, other state information specifying a plurality of performance values associated with a second system;

generating a forward-looking model, the forward-looking model specifying a relative weighting of the plurality of subsystems of the vehicle being associated with improved performance;

determining a performance value associated with the one or more subsystems of the plurality of subsystems of the vehicle based on the historic vehicle state information, the other state information and the forward-looking model; and generating and sending a signal based on the performance value.

2. The method of claim 1, further comprising:

identifying a personalization setting associated with a driver of the vehicle, the personalization setting indicating a degree of optimization; and weighting the performance value using the personalization setting.

3. The method of claim 1, wherein the performance value is a future fuel consumption rate and determining the performance value comprises:

identifying a plurality of acceleration rates associated with a plurality of fuel consumptions based on the historic vehicle state information;

wherein generating the forward-looking model specifies the future fuel consumption rate based on the plurality of acceleration rates associated with the plurality of fuel consumptions; and applying the forward-looking model to current vehicle state in the historic vehicle state information to determine a fuel consumption cost associated with accelerating the vehicle.

4. The method of claim 3, further comprising:

determining a first fuel consumption cost associated with accelerating the vehicle to an intersection;

determining a second fuel consumption cost associated with decelerating the vehicle to stop at the intersection; and determining whether to stop the vehicle responsive to determining whether the first fuel consumption cost exceeds the second fuel consumption cost.

5. The method of claim 1, wherein:

the other state information is historic neighbor vehicle state information specifying a plurality of performance values associated with a plurality of subsystems of a neighbor vehicle at the plurality of time points, including the current time point; and receiving at the vehicle includes receiving the historic neighbor vehicle state information from the neighbor vehicle proximate to the vehicle.

6. The method of claim 5, wherein the performance value indicates a future wait time associated with a queue with the neighbor vehicle and determining the performance value comprises:

identifying for the neighbor vehicle a plurality of green light reaction times based on the historic neighbor vehicle state information;

generating for the neighbor vehicle a neighbor forward-looking model that specifies a relative weighting of a future green light reaction time, based on the plurality of green light reaction times;

applying for the neighbor vehicle the neighbor forward-looking model to the historic neighbor vehicle state information to determine the future green light reaction time associated with the neighbor vehicle; and generating the future wait time responsive to summing one or more future green light reaction times associated with the queue.

7. The method of claim 5, wherein the performance value indicates a vehicle threat prediction value associated with the neighbor vehicle and determining the performance value comprises:

identifying a plurality of action codes based on the historic neighbor vehicle state information, wherein each action code indicates an action performed by the neighbor vehicle;

wherein the forward-looking model comprises a plurality of relative weightings, wherein each relative weighting indicates a probability that the neighbor vehicle will perform an action corresponding to an action code of the plurality of action codes; and applying the forward-looking model to the historic neighbor vehicle state information to generate the vehicle threat prediction value.

8. The method of claim 7, wherein the plurality of relative weightings are specific to a geographic position of the neighbor vehicle and applying the forward-looking model to the historic neighbor vehicle state information comprises:

identifying a current geographic position associated with the neighbor vehicle based on the historic vehicle state information; and determining a relative weighting that the neighbor vehicle will perform an action corresponding to an action code based on the geographic position of the neighbor vehicle specified in the historic neighbor vehicle state information.

9. The method of claim 8, wherein the plurality of relative weightings are each specific to a time when the actions are performed and applying the forward-looking model to the historic neighbor vehicle state information comprises determining a relative weighting that the neighbor vehicle will perform an action corresponding to an action code based on a current time.

10. The method of claim 7, wherein generating and sending a signal based on the performance value includes outputting a recommendation based on the performance value, the recommendation being to wait at an intersection responsive to determining that the vehicle threat prediction value associated with the neighbor vehicle indicates a threat to the vehicle.

11. The method of claim 7, wherein generating and sending a signal based on the performance value includes outputting a recommendation based on the performance value, the recommendation being to paceline with the neighbor vehicle responsive to determining that the vehicle threat prediction value associated with the neighbor vehicle does not indicate a threat to the vehicle.

12. The method of claim 1, wherein generating and sending a signal based on the performance value includes providing the driver of the vehicle with a tactile signal representing a recommendation.

13. The method of claim 1, wherein generating and sending a signal based on the performance value includes providing the driver of the vehicle with an audio signal representing a recommendation.

14. The method of claim 1, wherein generating and sending a signal based on the performance value includes providing the driver of the vehicle with a visual signal representing a recommendation.

15. The method of claim 1, wherein generating the forward-looking model includes:

generating a vehicle forward-looking model based on the historic vehicle state information, the vehicle forward-looking model specifying relative weightings of the plurality of subsystems of the vehicle being associated with improved performance; and generating a second forward-looking model based on the other state information, the second forward-looking model specifying relative weightings of the plurality of subsystems of the vehicle being associated with improved performance.

16. The method of claim 1, wherein generating and sending a signal based on the performance value includes sending a control signal that automatically adjusts the one or more subsystems of the plurality of subsystems to improve performance of the vehicle.

17. The method of claim 1, wherein the performance is one from a group of energy efficiency and emissions.

18. The method of claim 1 wherein:

the other state information is infrastructure state information specifying a plurality of performance values associated with infrastructure at the plurality of time points, including the current time point; and receiving at the vehicle includes receiving the infrastructure state information from a roadside access unit proximate to the vehicle.

19. The method of claim 18, wherein the infrastructure state information specifies a value associated with intersections and environmental conditions at the plurality of time points, including the current time point.

20. A system for managing vehicle performance, the system comprising:

an input device for receiving information about a vehicle including historic vehicle state information;

a communication device having an input and an output for receiving other state information;

a forward-looking model specifying relative weightings of one or more subsystems of the vehicle being associated with improved performance; and a performance management system having inputs and an output for determining a performance value associated with the one or more subsystems of the vehicle based on the historic vehicle state information, the other state information and the forward-looking model.

21. The system of claim 20, wherein the input device is one from a group of a vehicle sensor, an environmental sensor and a global positioning system.

22. The system of claim 20 comprising an automated vehicle adjustment module coupled to receive signals from the performance management system and convert the received signals to signals addressed to and for controlling the one or more subsystems of the vehicle.

23. The system of claim 20 comprising a signaling module coupled to receive signals from the performance management system and convert the received signals to instructions for presentation to a driver.

24. The system of claim 20, wherein the forward-looking model comprises:

a vehicle forward-looking model based on the historic vehicle state information, the vehicle forward-looking model specifying relative weightings of the one or more subsystems of the vehicle being associated with improved performance; and a second forward-looking model based on the other state information, the second forward-looking model specifying relative weightings of the other state information associated with improved performance.

25. The system of claim 24, wherein the second forward-looking model is a neighbor vehicle forward-looking model based on a plurality of relative weightings, wherein each relative weighting indicates whether a neighbor vehicle will perform an action corresponding to an action code of a plurality of action codes.

26. The system of claim 24, wherein the second forward-looking model is an infrastructure forward-looking model based on a plurality of relative weightings, wherein each relative weighting indicates whether infrastructure information is associated with improved performance.

27. The system of claim 24, wherein the communication device is a wireless communications device and receives one from a group of a Vehicle to Vehicle Message Set and an Infrastructure to Vehicle Message Set.

28. The system of claim 24, comprising a memory register for storing the historic vehicle state information and the other state information, the memory register coupled to the performance management system.

29. The system of claim 24, comprising a lookup table for storing one from a group of calculated distance, recommended speed, queue wait time, queue stop line distance, store distance, and other temporary variables.

* * * * *